US012364901B1

(12) United States Patent
Gao

(10) Patent No.: US 12,364,901 B1
(45) Date of Patent: Jul. 22, 2025

(54) ERGONOMIC HAND GRIP STRENGTHENER

(71) Applicant: MACBO TECHNOLOGIES LLC, Denver, CO (US)

(72) Inventor: Yiming Gao, Shenzhen (CN)

(73) Assignee: MACBO TECHNOLOGIES LLC, Denver, CO (US)

( * ) Notice: Subject to any disclaimer, the term of this patent is extended or adjusted under 35 U.S.C. 154(b) by 0 days.

(21) Appl. No.: 18/925,080

(22) Filed: Oct. 24, 2024

(30) Foreign Application Priority Data

Oct. 1, 2024 (CN) ..... 202430629072.7

(51) Int. Cl.
*A63B 23/16* (2006.01)
*A63B 21/00* (2006.01)
*A63B 21/02* (2006.01)

(52) U.S. Cl.
CPC ..... *A63B 23/16* (2013.01); *A63B 21/00069* (2013.01); *A63B 21/023* (2013.01); *A63B 21/4035* (2015.10)

(58) Field of Classification Search
CPC . A63B 23/16; A63B 21/00069; A63B 21/023; A63B 21/4035
See application file for complete search history.

(56) References Cited

U.S. PATENT DOCUMENTS 3,719,359 A * 3/1973 Evans ..... A63B 60/00 473/328
3,868,110 A * 2/1975 Jones ..... A63B 49/08 473/551
D264,737 S * 6/1982 Cooper ..... D21/684
4,887,814 A * 12/1989 Winter ..... A63B 37/14 473/596
5,060,934 A * 10/1991 Winston ..... A63B 23/16 482/126
D358,857 S * 5/1995 Yang ..... D21/684
5,820,522 A * 10/1998 Smallwood ..... A63B 23/16 482/49
D460,505 S * 7/2002 Yang ..... D21/692
6,881,177 B2 * 4/2005 An ..... A63B 21/4047 482/121
D561,850 S * 2/2008 Yang ..... D21/684
7,824,311 B1 * 11/2010 Hsu ..... A63B 23/16 482/126
8,133,158 B2 * 3/2012 An ..... A63B 23/16 482/44
10,881,903 B2 * 1/2021 An ..... A63B 23/16
11,052,283 B2 * 7/2021 An ..... A63B 23/16
D990,592 S * 6/2023 Ju ..... D21/684
2004/0003687 A1 * 1/2004 An ..... A63B 21/0004 606/206
2004/0088827 A1 * 5/2004 Tillim ..... A61B 17/1686 16/430

(Continued)

*Primary Examiner* — Andrew S Lo
(74) *Attorney, Agent, or Firm* — Ying-Ting Chen

(57) ABSTRACT

An ergonomic hand grip strengthener includes a front operation handle for ergonomic placement of an index finger, a middle finger, a ring finger and a pinky finger of the holding hand of the user, a rear operation handle for abutting against a thumb and a palm of the holding hand of the user, and a strength adjustment assembly for adjusting a resistance applied to approaching movement between the front operation handle and the rear operation handle.

6 Claims, 21 Drawing Sheets

(56) References Cited

U.S. PATENT DOCUMENTS

| | | | | |
|---|---|---|---|---|
| 2008/0103026 | A1* | 5/2008 | An | A63B 21/023 482/49 |
| 2015/0290491 | A1* | 10/2015 | An | A63B 21/00069 482/49 |
| 2019/0255383 | A1* | 8/2019 | An | A63B 21/00072 |
| 2019/0366145 | A1* | 12/2019 | Reda | A63B 1/00 |
| 2022/0387849 | A1* | 12/2022 | Wiseman | A63B 23/16 |
| 2023/0413928 | A1* | 12/2023 | Barajas | A63B 71/14 |

* cited by examiner

ERGONOMIC HAND GRIP STRENGTHENER

CROSS REFERENCE OF RELATED APPLICATION

This application is a non-provisional application that claims priority under 35 U.S.C. § 119 to China application number CN202430629072.7, filing date Oct. 1, 2024, wherein the entire content of which is expressly incorporated herein by reference.

BACKGROUND OF THE PRESENT INVENTION

Field of Invention

The present invention relates to hand grip trainer, and more particular to a hand grip strengthener with ergonomic operations arms.

Description of Related Arts

A typical hand grip strengthener includes two handles coupled by a spring or tension mechanism. The strength of the spring or tension mechanism determines the resistance provided by the device. The user can place his or her hand on the two handles and then squeeze the handles together to compress the spring or tension mechanism. The spring or tension mechanism provides resistance opposing the user's squeezing motion. And when the user releases the handles, the spring or tension mechanism is allowed to return to its original state.

Regular use of the hand grip strengthener can significantly enhance grip strength, which is beneficial for various activities, including sports, weightlifting, and everyday tasks. The muscles in the forearms are primarily responsible for grip strength. Using a hand grip strengthener can help develop and strengthen these muscles. The hand grip strengthener can also be used as part of a rehabilitation program to improve hand function after injuries or surgeries. In addition, most hand grip strengtheners are small and portable, making them easy to use anywhere.

As shown in F. 1 of the drawings, a conventional hand grip strengthener is illustrated to comprise a front handle 1, a rear handle 2, a spring mounting arm 3 and a spring 4. However, the front handle 1 of the conventional hand grip strengthener curves forward from top to bottom, forcing the user's smallest finger, the pinky, to rest on the most forward part of the front handle 1. This design is ergonomically unsound because that this design forces the user's pinky finger, being the shortest, to extend beyond the other fingers, placing it in an unnatural and unsupported position. This ergonomic flaw can lead to discomfort, reduced grip strength, and potential injuries over time.

With the pinky unable to fully engage, the responsibility of gripping shifts to the index, middle, and ring fingers. Data analysis reveals that the exclusion of the pinky from the grip reduces overall hand strength by almost 50%. This is a significant drop in functionality, especially in tasks where a strong, secure grip is essential.

In other words, an ergonomically sound handle would support the natural positioning of the fingers, distributing pressure evenly. The pinky finger, being weaker and shorter, should not be placed in a position of over extension or undue strain. The extended use of this design can lead to discomfort, as the pinky, and even the ring finger are forced into awkward positions. Over time, this can cause muscle fatigue, and the misalignment of the fingers leads to the potential development of overuse injuries, such as tendon strain.

In addition, as shown in FIG. 1, the rear handle 2 is inclined and the distance between the two handles 1 and 2 are gradually increasing from top to bottom, so that the inclination of the rear handle 2 can further misalign the ring finger and the pinky finger, forcing them to work in a compromised position that may not engage its strength effectively. The two fingers must stretch more to maintain contact with both handles. This can lead to an awkward grip posture. The increased distance forces the fingers, particularly the ring and pinky fingers, to extend further than their natural range, leading to strain and discomfort. In addition, the ring and pinky fingers bear the brunt of the awkward positioning, leading to an uneven distribution of pressure. This imbalance can inhibit the user's ability to apply optimal force during training, reducing the effectiveness of grip strengthening exercise.

Furthermore, as shown in FIG. 1, the rear handle 2 has an inclined surface 5 for the user to hold thereon, the rear handle 2 may reduce the surface area in contact with the palm of the user as a gap may be created between the hand and the inclined surface 5 of the rear handle 2, leading to uneven pressure distribution. A gap may also be created between a central area of the palm and a side surface of the rear handle 2 which is abutting against the central area of the palm. In addition, the rear handle 2 is also not ergonomic because the thumb cannot rest in a natural position, leading to strain and discomfort. This misalignment reduces overall grip effectiveness. The thumb and palm must exert extra force to maintain grip on the inclined surface, leading to fatigue and potential overuse injuries. The inclined design can cause uneven weight distribution among the fingers, particularly affecting the thumb, which may bear excessive load. This imbalance can weaken grip strength and stability.

SUMMARY OF THE PRESENT INVENTION

The invention is advantageous in that it provides an ergonomic hand grip strengthener which comprises two operation arms that are designed for ergonomically user-friendly handling during exercise.

Another advantage of the present invention is to provide an ergonomic hand grip strengthener, wherein the strategic positioning of the contact points of holding grooves of a front operation handle allows the shorter index and pinky fingers to engage with their grooves without excessive stretching. This minimizes strain, making the grip more comfortable during use.

Another advantage of the present invention is to provide an ergonomic hand grip strengthener, wherein compared to the middle finger, aligning the shorter index finger and pinky finger to be backward, the design minimizes the distance these fingers need to stretch. This reduces the risk of fatigue and overuse injuries, allowing users to focus on their training without discomfort.

Another advantage of the present invention is to provide an ergonomic hand grip strengthener, wherein in some embodiments, the contact point of the middle finger is positioned the farthest forward within its groove, allowing for optimal engagement during use. This forward placement provides the middle finger with a stable and prominent position for applying force. With the middle finger firmly positioned forward, it serves as a strong anchor for the grip. This stability is essential for maintaining control during exercises, especially those requiring precision and strength.

Another advantage of the present invention is to provide an ergonomic hand grip strengthener, wherein the holding groove dedicated to the pinky finger is specifically shaped and positioned for conforming to its shorter length, so that the pinky finger does not have to stretch far from its natural resting position. This minimized stretching distance allows the finger to engage more comfortably and securely.

Another advantage of the present invention is to provide an ergonomic hand grip strengthener, wherein by allowing the pinky finger to naturally rest against the bottom surface of the corresponding holding groove, the design increases the contact area between the finger and the front operation handle. This larger contact area provides a more stable grip, as the pinky finger can effectively contribute to grip strength without straining. With the pinky finger securely positioned and making maximum contact with the front operation handle, the stability is crucial for maintaining control during various exercises.

Another advantage of the present invention is to provide an ergonomic hand grip strengthener, wherein the pinky finger is allowed to be fully engaged with the front operation handle, it contributes significantly to the force exerted by the entire hand. With full involvement of the pinky finger in the grip, the user experiences a noticeable increase in grip power, which can enhance the performance of tasks that require sustained gripping force.

Another advantage of the present invention is to provide an ergonomic hand grip strengthener, wherein following the natural contour of the holding hand, the structure of the front operation handle promotes proper finger alignment, allowing for more effective grip and improved overall stability. The ergonomic curve allows for more even force distribution across all fingers, enhancing grip strength and control. The, index, ring and pinky fingers can contribute more effectively to the overall grip without feeling overextended.

Another advantage of the present invention is to provide an ergonomic hand grip strengthener, wherein the front operation handle accommodates all four fingers with dedicated gripping grooves for the index, middle, ring, and pinky fingers. Each groove is tailored to the shape and size of the respective finger, ensuring a snug fit.

Another advantage of the present invention is to provide an ergonomic hand grip strengthener, wherein the rear operation handle features a concave groove that is shaped to fit the natural contour of the thumb. This groove provides a secure and comfortable resting place, allowing the thumb to maintain a natural position during use. The bottom surface of the concave groove is positioned such that the contact point of the thumb is directed forward. This forward positioning allows the thumb to exert pressure effectively while maintaining an ergonomic grip.

Another advantage of the present invention is to provide an ergonomic hand grip strengthener, wherein the rear curve of the rear operation handle is designed to gradually protrude backward along a direction toward its bottom end. This contour creates an ergonomic shape that aligns with the natural curve of the palm, ensuring a secure and comfortable fit. The slight protrusion increases the contact area between the palm and the rear operation handle. This larger surface area allows for better distribution of pressure and enhances the overall grip experience.

Another advantage of the present invention is to provide an ergonomic hand grip strengthener, wherein the addition of elastic protrusions to the operation handles of the ergonomic hand grip strengthener provides a dual function, combining the primary objective of muscle strengthening with the added benefit of hand massage.

Additional advantages and features of the invention will become apparent from the description which follows, and may be realized by means of the instrumentalities and combinations particularly pointing out in the appended claims.

According to the present invention, the foregoing and other objects and advantages are attained by an ergonomic hand grip strengthener for being gripped by a holding hand of a user, comprising:

- a front operation handle for placement of an index finger, a middle finger, a ring finger and a pinky finger of the holding hand of the user;
- a rear operation handle for abutting against a thumb and a palm of the holding hand of the user; and
- a strength adjustment assembly for adjusting a resistance applied to approaching movement between the front operation handle and the rear operation handle.

According to an embodiment, the front operation handle comprises a front abutting surface which comprises an upper surface section and a lower surface section which is integrally extended from the upper surface section, wherein along a direction from top to bottom, the upper surface section is gradually protruding frontward while the lower surface section is gradually receding backward.

According to an embodiment, the upper surface section of the front abutting surface is arranged for being gripped by the index finger and the middle finger, the lower surface section of the front abutting surface is arranged for being griped by the ring finger and the pinky finger.

According to an embodiment, the front operation handle comprises a first groove profile surface defining a first holding groove for holding the index finger, a second groove profile surface defining a second holding groove for holding the middle finger, a third groove profile surface defining a third holding groove for holding the ringer finger, and a fourth groove profile surface defining a fourth holding groove for holding the pinky finger.

According to an embodiment, the first groove profile surface comprises a first middle line, the second groove profile surface comprises a second middle line, the third groove profile surface comprises a third middle line, the fourth groove profile surface comprises a fourth middle line, wherein the first middle line has a first central contact position, the second middle line has a second central contact position, the third middle line has a third central contact position, the fourth middle line has a fourth central contact position, wherein the first central contact position is positioned backward compared with the second central contact position, wherein the fourth central position is positioned backward compared with the third central contact position.

According to an embodiment, the first groove profile surface is configured to be symmetrical with respect to the first middle line, the second groove profile surface is configured to be symmetrical with respect to the second middle line, the third groove profile surface is configured to be symmetrical with respect to the third middle line, the fourth groove profile surface is configured to be symmetrical with respect to the fourth middle line.

According to an embodiment, the first holding groove is positioned further back than the second holding groove, wherein the fourth holding groove is positioned further back than the third holding groove.

According to an embodiment, one of the second holding groove and the third holding groove is at a foremost position among the first holding groove, the second holding groove, the third holding groove and the fourth holding groove.

According to an embodiment, one of the fourth holding groove and the first holding groove is at a rearmost position among the first holding groove, the second holding groove, the third holding groove and the fourth holding groove.

According to an embodiment, each of the first holding groove, the second holding groove, the third holding groove and the fourth holding groove is extended along a circumferential direction and occupies a quarter to three quarters of a circumference of the front operation handle.

According to an embodiment, each of the first holding groove, the second holding groove, the third holding groove and the fourth holding groove is positioned circumferentially around the front operation handle and covers a 180-degree arc or greater.

According to an embodiment, the front operation handle comprises a rear extension surface, wherein from top to bottom, the rear extension surface is gradually protruding frontward first, and then gradually receding backward.

According to an embodiment, the rear operation handle comprises an arm body and a protrusion part extended from a side of the arm body for conforming to a groove of the palm of the holding hand of the user.

According to an embodiment, the rear operation handle has a concave groove for placement of the thumb, wherein the concave groove is extended along a circumferential direction and occupies a quarter to three quarters of a circumference of the rear operation handle.

According to an embodiment, the rear operation handle has a concave groove for placement of the thumb, wherein the concave groove is positioned circumferentially around the rear operation handle and covers a 180-degree arc or greater.

According to an embodiment, the rear operation handle comprises a rear abutment surface which comprises a top abutting surface section, a thumb abutting surface section extended from the top abutting surface section to define a concave groove for placing the thumb, and a palm abutting surface section extended from the thumb abutting surface section for abutting against the palm of the holding hand of the user.

According to an embodiment, the palm abutting surface section comprises a first abutting surface portion and a second abutting surface portion extended from the first abutting surface portion, wherein from top to bottom, the thumb abutting surface section is gradually protruding backward, the first abutting surface portion is gradually protruding backward while the second abutting surface portion is gradually receding frontward, wherein the first abutting surface portion and the second abutting surface portion are converged at a backward protruding peak position.

According to an embodiment, the rear operation handle comprises a rear abutment surface which comprises a top abutting surface section, a thumb abutting surface section extended from the top abutting surface section to define a concave groove for placing the thumb, and a palm abutting surface section extended from the thumb abutting surface section for abutting against the palm of the holding hand of the user, wherein the palm abutting surface section comprises a first abutting surface portion and a second abutting surface portion extended from the first abutting surface portion, wherein from top to bottom, the thumb abutting surface section is gradually protruding backward, the first abutting surface portion is gradually protruding backward while the second abutting surface portion is gradually receding frontward, wherein the first abutting surface portion and the second abutting surface portion are converged at a backward protruding peak position.

According to an embodiment, wherein the front operation handle comprises a first groove profile surface defining a first holding groove for holding the index finger, a second groove profile surface defining a second holding groove for holding the middle finger, a third groove profile surface defining a third holding groove for holding the ringer finger, and a fourth groove profile surface defining a fourth holding groove for holding the pinky finger, wherein the first holding groove, the second holding groove, the third holding groove and the fourth holding groove are differed in widths for conforming to the index finger, the middle finger, the ring finger and the pinky finger.

According to an embodiment, a fourth width of the fourth holding groove is smaller than a third width of the third holding groove.

According to an embodiment, a first width of the first holding groove is larger than a second width of the second holding groove which is larger than a third width of the third holding groove, wherein a third width of the third holding groove is larger than a fourth width of the fourth holding groove.

According to an embodiment, the rear operation handle further has a lower concave groove.

The present invention further provides an ergonomic hand grip strengthener for being gripped by a holding hand of a user, comprising:

- a front operation handle for placement of an index finger, a middle finger, a ring finger and a pinky finger of the holding hand of the user, wherein the front operation handle is configured to allow the pinky finger to be positioned further back than the ring finger;
- a rear operation handle for abutting against a thumb and a palm of the holding hand of the user; and
- a strength adjustment assembly for adjusting a resistance applied to approaching movement between the front operation handle and the rear operation handle.

According to an embodiment, the front operation handle is configured to allow the index finger to be positioned further back than the middle finger.

According to an embodiment, the front operation handle comprises a front abutting surface which is configured to allow the pinky finger to be positioned further back than the ring finger and allow the index finger to be positioned further back than the middle finger.

According to an embodiment, the front operation handle has four holding grooves which are configured to allow the pinky finger to be positioned further back than the ring finger and allow the index finger to be positioned further back than the middle finger.

According to an embodiment, the rear operation handle comprises a rear abutment surface which has a substantial S-shape.

According to an embodiment, at least one of the front operation handle and the rear operation handle is provided with a plurality of resilient protrusions.

Still further objects and advantages will become apparent from a consideration of the ensuing description and drawings.

These and other objectives, features, and advantages of the present invention will become apparent from the following detailed description, the accompanying drawings, and the appended claims.

DETAILED DESCRIPTION OF THE PREFERRED EMBODIMENT

The following description is disclosed to enable any person skilled in the art to make and use the present invention. Preferred embodiments are provided in the following description only as examples and modifications will be apparent to those skilled in the art. The general principles defined in the following description would be applied to other embodiments, alternatives, modifications, equivalents, and applications without departing from the spirit and scope of the present invention.

Referring to FIG. 2 to FIG. 7B of the drawings, an ergonomic hand grip strengthener according to a first preferred embodiment of the present invention is illustrated, the ergonomic hand grip strengthener comprises a front operation handle 10, a rear operation handle 20, and a strength adjustment assembly 30 for adjusting the resistance applied to the approaching movement of the front operation handle 10 and the rear operation handle 20. The strength adjustment assembly 30 can be adjusted to increase or decrease the difficulty level, so as to provide a customizable workout experience to accommodate different strength levels and training goals of the user.

Figure 6A:
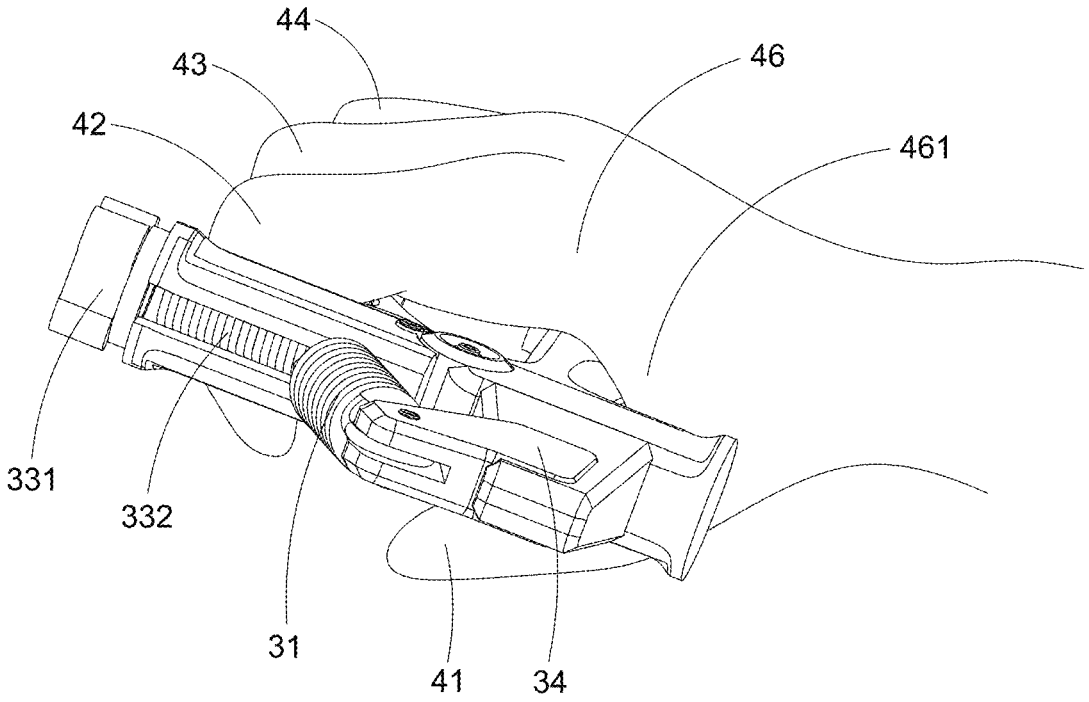
FIG. 6A is a perspective view illustrating the ergonomic hand grip strengthener being held in a holding hand of a user according to the above first preferred embodiment of the present invention.
Figure 6B:
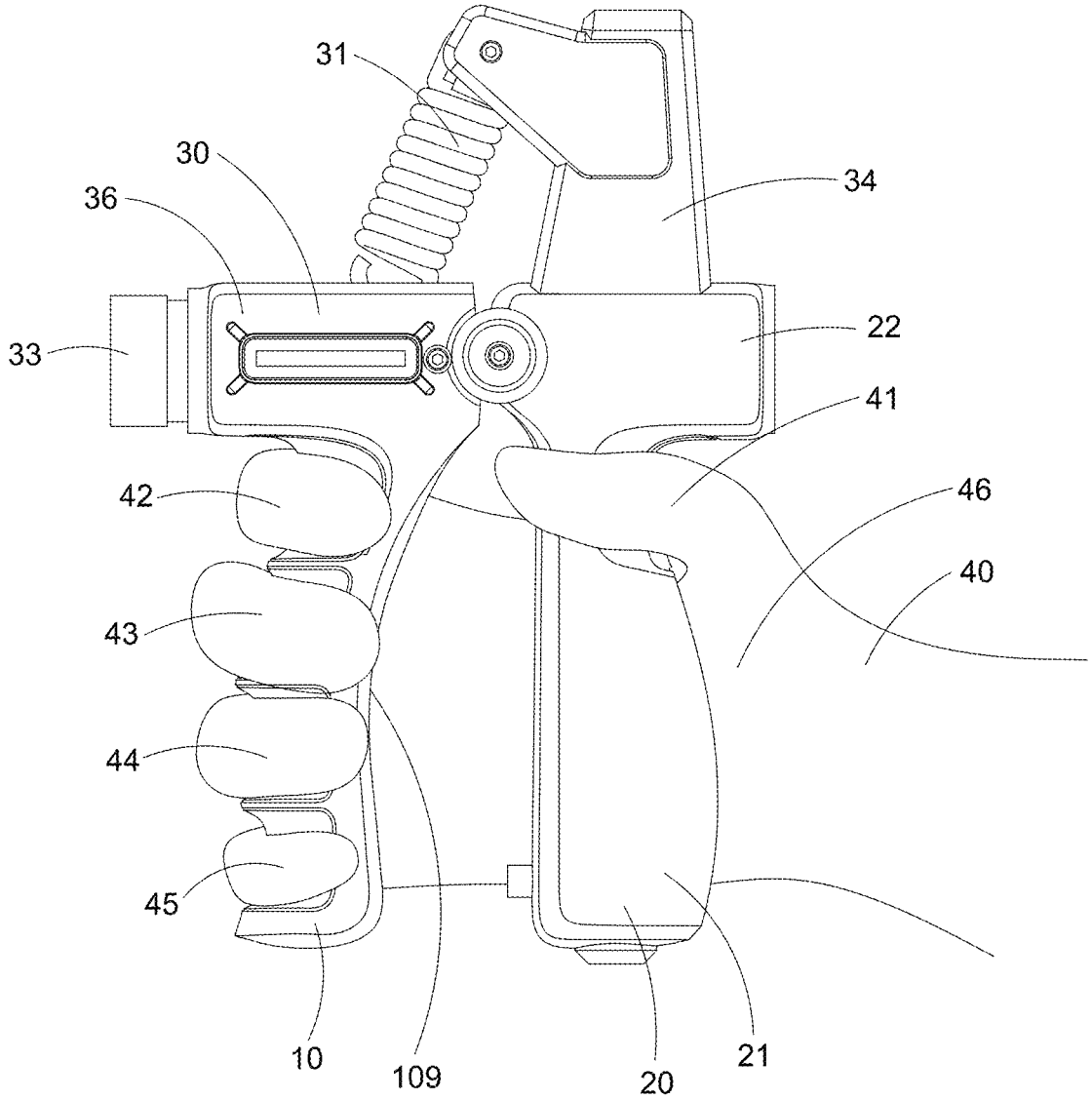
FIG. 6B is another perspective view illustrating the ergonomic hand grip strengthener being held in the holding hand of the user according to the above first preferred embodiment of the present invention.

As shown in FIGS. 6A and 6B of the drawings, when the user places his or her holding hand 40 in front of his or her body to hold and grip the ergonomic hand grip strengthener, an index finger 42, a middle finger 43, a ring finger 44 and a pinky finger 45 of the holding hand 40 are in front of a thumb 41 and a palm 46, the rear operation handle 20 is defined as a handle that is abutting against the thumb 41 and the palm 46 of the holding hand 40 of the user and the front operation handle 10 is defined as a handle that is in front of the rear operation handle 20 and is griped by the index finger 42, the middle finger 43, the ring finger 44 and the pinky finger 45 of the holding hand 40 of the user.

The front operation handle 10 serves as the primary handle for the fingers of the holding hand of the user. It is positioned in front of the rear operation handle 20 and is designed to be gripped by the index, middle, ring, and pinky fingers 42, 43, 44 and 45 of the user's holding hand 40. The front operation handle 10 is where the majority of the gripping force is applied during the exercise, contributing to finger strength development.

The rear operation handle 20 acts as the handle that rests against the palm 46 of the holding hand 40 of the user when the ergonomic hand grip strengthener is held. It is positioned behind the front operation handle 10 and provides support for the thumb 41 and the palm 46, ensuring a firm and stable grip.

In the present invention, the front operation handle 10 is the operation arm in front of the rear operation handle 20, meaning that the index, middle, ring and pinky fingers 42, 43, 44 and 45 of the holding hand 40 of the user grasp the front operation handle 10 while the palm presses against the rear operation handle 20. This layout mimics the natural orientation of the hand when gripping an object, ensuring that both arms of the ergonomic hand grip strengthener work together to provide a balanced and ergonomic grip.

Figure 1:
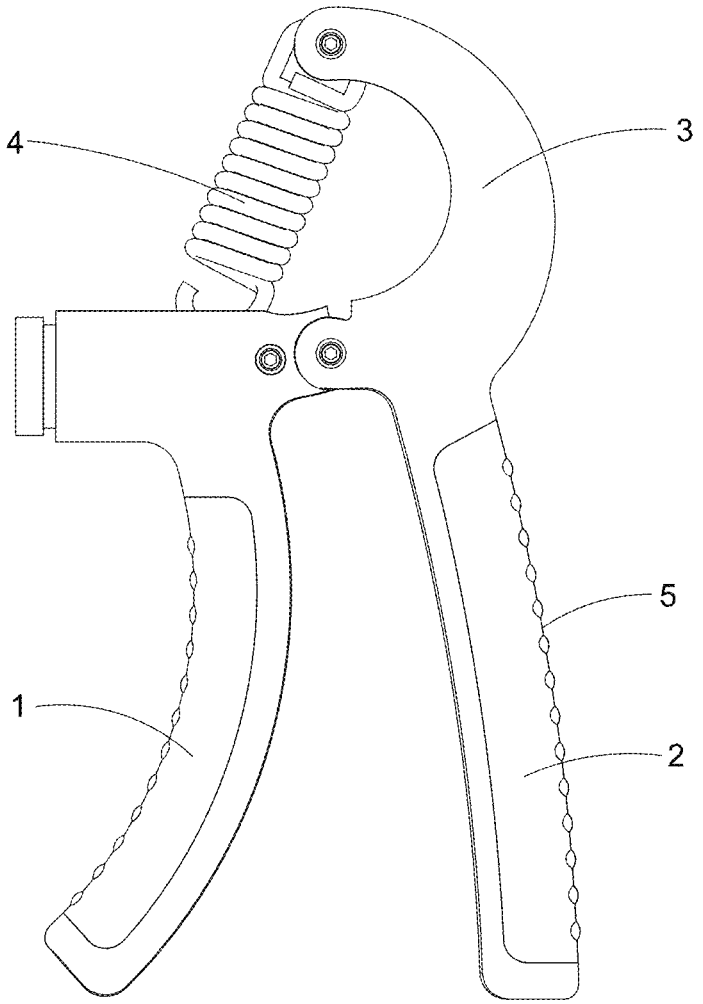
PRIOR ART Fig.1
FIG. 1 is a perspective view of a conventional hand grip strengthener.
Figure 2:
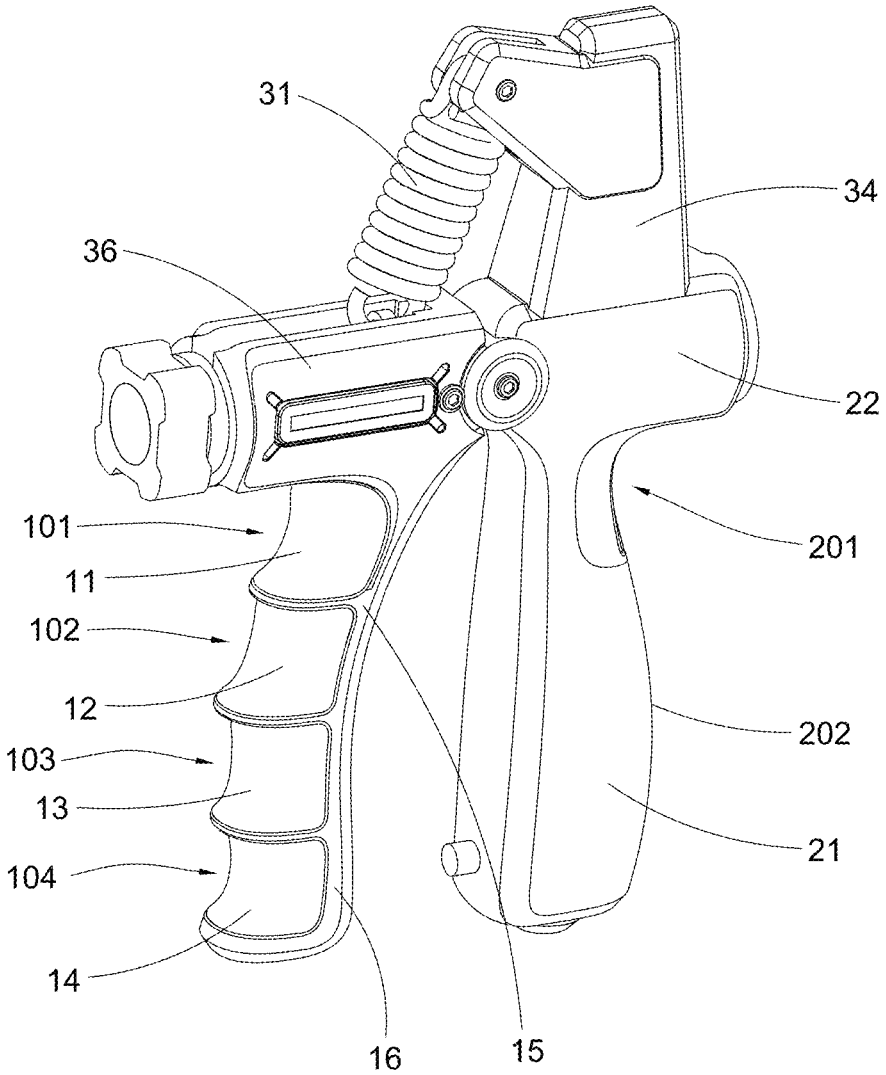
FIG. 2 is a perspective view of an ergonomic hand grip strengthener according to a first preferred embodiment of the present invention.
Figure 3:
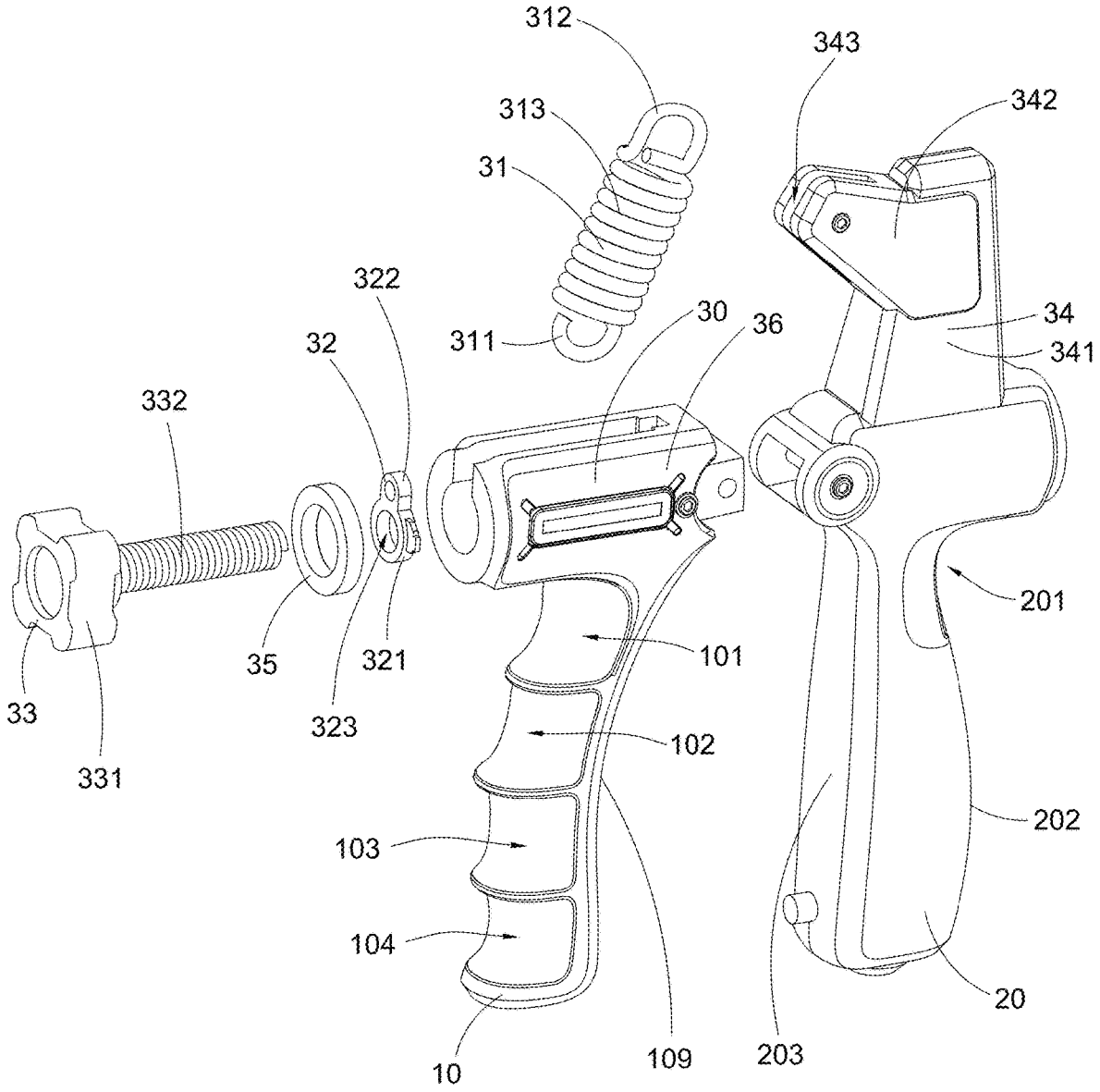
FIG. 3 is an exploded view of the ergonomic hand grip strengthener according to the above first preferred embodiment of the present invention.

A shown in FIG. 2 and FIG. 3, the strength adjustment assembly 30 comprises a spring element 31, a spring driving element 32, an adjustment control element 33, a spring mounting element 34 and a base arm 36. The spring element 31 is arranged to generate a resistance force to the relative movement between the front operation handle 10 and the rear operation handle 20, the adjustment control element 33 can be operated by the user, so as to drive the spring driving element 32 to move, and thus the spring element 31 is driven to move and deform, so as to adjust the resistance force. The spring mounting element 34 is arranged for mounting the spring element 31.

More specifically, the spring element 31 comprises a moving end portion 311, a fixing end portion 312, and a spring body 313 extended between the moving end portion 311 and the fixing end portion 312. The fixing end portion 312 is an end portion that is opposite to the moving end portion 311 and is fixed to the spring mounting element 34. In this embodiment, the spring mounting element 34 is connected to a top of the rear operation handle 20, and the spring element 31 is inclinedly extended between the spring mounting element 34 and the base arm 36.

As shown in FIG. 3 of the drawings, the moving end portion 311 and the fixing end portion 312 can be hook end portions which are respectively connected to the spring driving element 32 and the spring mounting element 34.

The spring mounting element 34 comprises an extending portion 341 which is extended from the top of the rear operation handle 20 and a connecting portion 342 which is inclinedly or curvedly extended from the extending portion 341 for mounting the fixing end portion 312 of the spring element 31.

The connecting portion 342 has a connecting groove 343 for disposing the fixing end portion 312 of the spring element 31, a connecting pin can be penetrating through the fixing end portion 312 of the spring element 31 and the connecting portion 342 for mounting the fixing end portion 312 of the spring element 31 to the connecting portion 342 of the spring element 34. The person of ordinary skilled in the art should understand the above connecting manner between the connecting portion 342 of the spring mounting element 34 and the fixing end portion 312 of the spring element 31 is exemplary only and is not intended to be limiting.

The adjustment control element 33 comprises an adjusting knob 331 and a driving shaft 332 connected to the adjusting knob 331 and is disposed in the base arm 36, the spring driving element 32, which is disposed in the base arm 36, is movably coupled on the driving shaft 332 in a manner that when the adjusting knob 331 is rotated, the spring driving element 32 will be driven to move by the driving shaft 332, so as to further drive the moving end portion 311 of the spring element 31 to move, so that the spring body 313 is deformed into different tension states to generate different resistances to the relative movement between the front operation handle 10 and the rear operation handle 20.

The driving shaft 332 comprises outer threads on an outer surface thereof, the spring driving element 32 comprises a moving member 321 wound around the driving shaft 332 and a driving member 322 connected to the moving member 321 for driving the movement of the moving end portion 311 of the spring element 31.

The moving member 321 has a central hole 323 and comprises inner threads on an inner ring surface around the central hole 323 thereof for engaging with the outer threads of the driving shaft 332, so that the moving member 321 is screwed on the driving shaft 332. Therefore, when the adjusting knob 331 is rotated, the driving shaft 332 will be rotating, and the moving member 321 will be driven to move along the driving shaft 332 because of the screwing connection between the driving shaft 332 and the moving member 321, and thus the moving end portion 311 of the spring element 31 connected to the driving member 332 will be driven to move to adjust its position to result in the deformation of the spring body 313, so that the stretched state of the spring body 313 is adjusted, and thus the adjustable resistance of the hand grip strengthener can be provided.

In this embodiment, the spring element 31 can be a compression spring, the movement of the moving end portion 311 of the spring element 31 will result in different stretching states of the compression spring, so as to adjust the resistance of the spring element 31 applied to the relative movement between the front operation handle 10 and the rear operation handle 20.

The driving member 322 has a connecting hole, the moving end portion 311 of the spring element 31 is hooked on the driving member 322 by passing through the connecting hole, so that the spring element 31 is connected to the driving member 322 of the spring driving element 32. The person of ordinary skilled in the art should understand that the connecting manner between the driving member 322 and the spring element 31 is exemplary only, and is not intended to be limiting.

The strength adjustment assembly 30 may further comprise a flexible ring 35 which is arranged between an end portion of the base arm 36 and the adjusting knob 331. The flexible ring 35 is wound around the driving shaft 332 to block the further inward rotating movement of the adjusting knob 331, prevent the frictional contact between the end portion of the base arm 36 and the adjusting knob 331, as well as to block the further movement of the spring driving element 32.

The front operation handle 10 is connected to the base arm 36, the base arm 36 is movably coupled with the rear operation handle 20, so as to allow the front operation handle 10 and the rear operation handle 20 to be moved close to each other or to be moved away from each other for hand strength exercising.

In this embodiment, as shown in FIGS. 2 to 5, the rear operation handle 20 comprises an arm body 21 and a connecting arm 22 transversely extended from the arm body 21. The connecting arm 22 is pivotally coupled to the base arm 36 which is connected to the front operation handle 10, so that the pivotal movement between the connecting arm 22 and the base arm 36 will allow the relative movement between the front operation handle 10 and the rear operation handle 20.

The pivotal coupling between the connecting arm 22 and the base arm 36 allows the front and rear operation handles 10 and 20 to move smoothly toward each other. In other words, the pivotal connection forms a hinge-like mechanism, allowing for controlled, relative movement between the front and rear operation handles 10 and 20. This provides a more natural motion when the user applies pressure, ensuring that the movement closely resembles the natural action of squeezing a handgrip.

The arm body 21, which forms the main part of the rear operation handle 20, is designed to rest against and be pressed by the palm 46 of the holding hand 40 of the user during use. Its shape is typically contoured to provide ergonomic support to the palm 46, improving grip stability and comfort.

More specifically, the rear operation handle 20 has a concave groove 201 formed under the connecting arm 22 at a rear side of the rear operation handle 20 for the placement of the thumb 41 of the holding hand 40 of the user. In this embodiment, the concave groove 201 is an indented groove located under the connecting arm 22 and is designed to cradle and support the thumb 41 and an upper edge portion 461 of the palm 46 when the user grips the ergonomic hand grip strengthener with his or her holding hand 40.

The concave groove 201 is positioned underneath the connecting arm 22, meaning that when the user wraps the holding hand 40 around the hand grip strengthener, a root of the thumb 41 naturally rests in this concave groove 201. This positioning aligns with the natural anatomy of the holding hand 40, reducing strain and enhancing grip stability. The shape and depth of the concave groove also ensure that the thumb 41 fits securely, preventing it from slipping during the squeezing motion.

Figure 5:
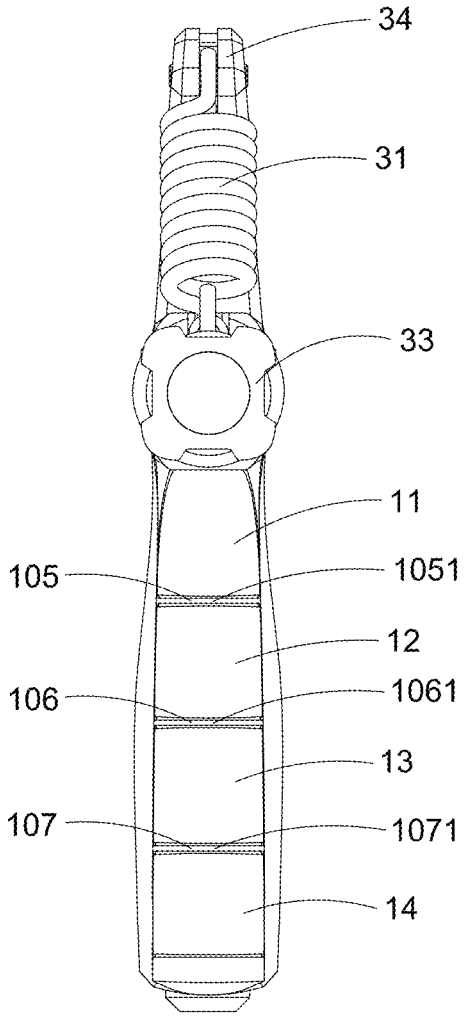
FIG. 5 is a schematic view illustrating a front operation handle of the ergonomic hand grip strengthener according to the above first preferred embodiment of the present invention.

As shown in FIG. 5, the concave groove 201 allows the thumb 41 and the upper edge portion 461 of the palm 46 to be placed in a natural, comfortable position. Without needing to overextend or strain, the thumb 41 can rest securely in the concave groove 201, improving overall hand alignment and reducing the risk of discomfort or fatigue during prolonged use.

In addition, the design of the concave groove 201 helps ensure that the thumb 41 remains anchored to the rear operation handle 20, even during the application of force. This prevents slipping and enhances the stability of the entire grip, allowing the user to exert more controlled pressure with their fingers.

By providing a designated space for the thumb 41, the concave groove 201 contributes to better control over the movement of the two operation handles 10 and 20. The user can achieve a more balanced and effective grip, improving the efficiency of the exercise by allowing both the thumb 41 and fingers to engage fully.

Without the concave groove 201, the thumb 41 might have to maintain an awkward position or press against a flat or inclined surface, which could cause strain or discomfort. The design of the concave groove 201 alleviates this by providing a contoured resting place, making the grip more comfortable, especially during repeated or extended use.

Figure 4:
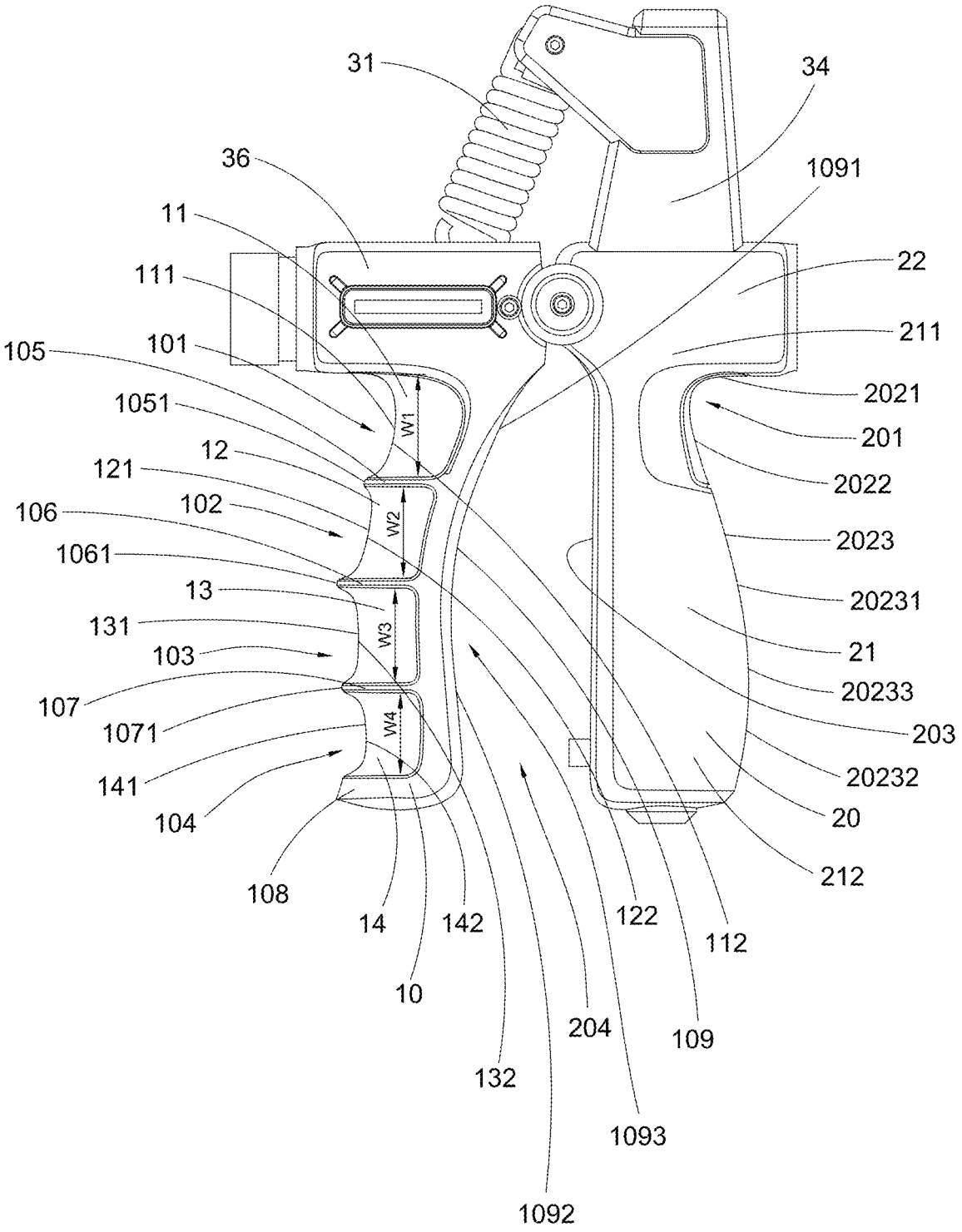
FIG. 4 is a side schematic view of the ergonomic hand grip strengthener according to the above first preferred embodiment of the present invention.

As shown in FIG. 4, in this embodiment, the concave groove 201 is indented along a circumferential direction of the arm body 21 and is preferred to occupy a quarter to three quarters of a circumference of the rear operation handle 20. Preferably, the circumferential concave groove 201 occupies not less than half of a circumference of the arm body 21. In other words, the concave groove 201 is positioned circumferentially around the arm body 21 and covers a 180-degree arc or greater.

The concave groove 201 extends across not less than half of the circumference of the arm body 21, meaning it occupies a significant portion, covering a greater than 180-degree arc. This design ensures that the thumb 41 has ample surface area for contact, regardless of slight positional adjustments made by the user. Accordingly, the wide circumferential coverage of the concave groove 201 allows the thumb 41 to rest securely and comfortably against the arm body 21 of the rear operation handle 20. This broad contact area prevents the thumb 41 from slipping, ensuring that it remains in position even during forceful grip exercises. The extended concave groove 201 ensures that the thumb 41 has sufficient support across a wide range of thumb positions, making it adaptable to different users' thumb lengths and natural hand postures.

By spanning more than half of the circumference of the arm body 41, the concave groove 201 ensures that the thumb 41 remains securely positioned, whether the user adjusts the holding hand 40 or changes grip pressure. The circumferential placement allows the root of the thumb 41 and the upper edge portion 461 of the palm 46 to naturally fit into the concave groove 201 from various angles, making it adaptable to different hand sizes and grip styles.

The circumferential indentation ensures that the thumb 41 remains in a natural, relaxed position, reducing stress on the thumb joint and muscles. The thumb 41 can easily conform to the concave groove 201 without needing to overextend or press against a flat surface, which might cause discomfort. This ergonomic positioning reduces the risk of thumb fatigue during prolonged use, making the strengthener suitable for extended exercise sessions In addition, by occupying more than half of the circumference, the concave groove 201 provides the thumb 201 with a more encompassing grip surface. This increases the overall stability of the handgrip, allowing the user to exert greater pressure and control when using the strengthener.

Furthermore, the design of the concave groove 201 in the arm body 21 under the connecting arm 22 of the rear operation handle 20 offers a significant ergonomic advantage by allowing the root of the thumb 41 to be placed forward, which in turn reduces the need for the shorter index finger 42 to stretch excessively.

More specifically, the concave groove 201 is indented along the circumference of the arm body 21 of the rear operation handle 20 and is designed to fit the root of the thumb 41 comfortably. By creating a forward-positioned resting place for the thumb 41, this concave groove 201 supports a natural hand posture.

The concave groove 201 allows the root of the thumb 41 to be positioned further forward on the rear operation handle 20. This positioning aligns the thumb 41 closer to the front operation handle 10 of the hand grip strengthener, offering a more balanced and natural grip. With the thumb 41 in a forward position, the grip of the holding hand 40 is adjusted in such a way that the shorter index finger 42 does not need to extend far to reach its gripping point on the front operation handle 10. This prevents overstretching and discomfort in the index finger 42.

By positioning the thumb root forward, the holding hand 40 can maintain a more relaxed and natural posture, allowing the fingers, especially the index finger 42, to grip the front operation handle 10 without strain. The ergonomic alignment of the thumb 41 reduces the strain on the index finger 42 and improves the overall efficiency of the grip. This design ensures that rest fingers, especially the index finger 42, can engage with the front operation handle 10 in a more natural way, making the strengthener more comfortable for extended use.

In this embodiment, the concave groove 201 is formed at an upper end portion 211 of the arm body 21 at a rear side thereof. Alternatively, the arm body 21 may be provided with a resilient cover and a surface of the resilient cover is indented to form the concave groove 201.

As shown in FIGS. 2 to 4 of the drawings, the rear operation handle 20 comprises a rear abutting surface 202 under the connecting arm 22 for abutting the holding hand 40 of the user. The rear abutting surface 202 comprises a top abutting surface section 2021 for abutting against the back of the thumb 41 and the upper edge portion 461 of the palm 46, a thumb abutting surface section 2022 for abutting an inner surfaces of the thumb 41 and the upper edge portion 461 of the palm 46, a palm abutting surface section 2023 for abutting against the palm 46 of the holding hand.

The thumb abutting surface section 2022 is inclinedly or curvedly extended from the top abutting surface section 2021 for defining the concave groove 201 under the connecting arm 22. As shown in FIG. 4 of the drawings, the thumb abutting surface section 2022 is gradually protruding backward along a direction toward the palm abutting surface section 2023. The gradual backward protrusion of the thumb abutting surface section 2022 allows the thumb 41 to rest comfortably in a more natural position. Instead of being forced into an unnatural angle, the thumb 41 follows the curve of the rear operation handle 20, reducing strain during gripping and ensuring a more relaxed hold.

The backward protrusion helps increase the contact area between the thumb 41 and the rear operation handle 20. By shaping the surface to follow the natural grip motion of the thumb 41, the design ensures that more surface area is in contact with the thumb 41. This improves grip stability and makes the user feel more secure while holding the strengthener.

The backward protrusion also provides an anchor-like effect for the thumb 41, allowing it to engage with the rear operation handle 20 more firmly. This ensures that the thumb 41 remains securely positioned even during intense grip exercises, reducing the risk of the thumb slipping and enhancing control over the ergonomic hand grip strengthener.

The palm abutting surface section 2023, which is extended from the thumb abutting surface section 2022, comprises a first abutting surface portion 20231 and a second abutting surface portion 20232 extended from the first abutting surface portion 20231. The first abutting surface portion 20231 is gradually protruding backward along a direction toward a lower end portion 212 of the arm body 21 while the second abutting surface portion 20232 is gradually protruding backward along a direction toward the upper end portion 211 of the arm body 21 until the two surface portions are converged at a backward protruding peak position 20233.

The dual sections of the palm abutting surface section 2023 ensure that different parts of the palm are supported effectively. The first abutting surface portion 20231 follows the upper curve of the palm 46 while the second abutting surface portion 20232 follows the lower curve of the palm 46. This dual design adapts to the natural contours of the holding hand 40, providing better support for the entire palm.

The gradual backward protrusion of both abutting surface portions 20231 and 20232 mirrors the natural curvature of the palm 46. This design ensures that the holding hand 40 can wrap around the rear operation handle 20 comfortably, distributing pressure evenly across the palm 46 and reducing strain.

The convergence of the two surface portions at the backward protruding peak position 20233 provides a stable and secure contact point. This peak fits into the natural hollow of the palm 46, so that the gap between the palm 46 and and the rear operation handle 20 is reduced and the contact area between the palm 46 and the rear operation handle 20 is increased, so as to anchor the holding hand 40 firmly onto the hand grip strengthener and prevent any slippage during use, even when applying high pressure.

The backward protruding design of both surface portions 20231 and 20232, culminating in the backward protruding peak position 20233, allows the user to maintain better control over the hand grip strengthener during exercises. The holding hand 40 is positioned naturally, reducing the effort needed to maintain a firm grip, which enhances both comfort and control during use.

The backward protruding peak position 20233 also acts as a reference point for hand positioning. This helps users intuitively place the palm 46 in the correct position, ensuring optimal alignment and preventing awkward hand postures that could lead to discomfort or injury.

Preferably, in this embodiment, the rear abutting surface 202 is actually embodied to have a substantial "S" shape by configuring extending direction of the top abutting surface section 2021, the thumb abutting surface section 2022, and the palm abutting surface section 2023, so as to conform to the thumb 41 and the palm 46 of the holding hand 40. The S-shaped rear abutting surface 202 is designed to mimic the natural curve of the thumb 41 and palm 46 when gripping. This configuration enhances the ergonomic feel, allowing the holding hand 40 to rest comfortably on the rear operation handle 40 without requiring unnatural stretching or repositioning. The contours of the S-curve ensure that the rear operation handle 40 molds to the user's hand shape for a snug fit.

This configuration creates natural contours that the holding hand 40 can grasp securely. The thumb 41 is cradled in the upper concave groove 201, while the palm 46 is supported by the lower curve, ensuring the holding hand 40 remains stable on the rear operation handle 20 even during vigorous exercise movements. The smooth transitions between sections prevent slipping and allow for better control of the ergonomic hand grip strengthener. This curve configuration also ensures that the holding hand 40 is not forced into awkward positions, reducing the risk of strain or injury over time by helping the user maintain a comfortable and effective grip during use.

Referring to FIGS. 2 to 7B of the drawings, the front operation handle 10 is extended from a bottom of the base arm 36 and has a first holding groove 101 for the placement of the index finger 42 of the holding hand 40, a second holding groove 102 for the placement of the middle finger 43 of the holding hand 40, a third holding groove 103 for the placement of the ring finger 44 of the holding hand 40, and a fourth holding groove 104 for the placement of the pinky finger 45 of the holding hand 40.

According to this embodiment, each of the first holding groove 101, the second holding groove 102, the third holding groove 103 and the fourth holding groove 104 is indented along a circumferential direction of the front operation handle 10. Preferably, each circumferential holding groove occupies a quarter to three quarters of a circumference of the front operation handle 10. Preferably, as an example, each concave holding groove is positioned circumferentially around the front operation handle 10 and covers a 180-degree arc or greater.

Accordingly, the front operation handle of the ergonomic hand grip strengthener is designed with four distinct holding grooves 101 to 104 to accommodate the four fingers 42 to 45 of the holding hand 40 of the user, each groove corresponding to a specific finger. These grooves are indented along the circumferential direction of the front handle to provide an ergonomic and secure grip.

The circumferential design of each holding groove allows the fingers to naturally grip around the front operation handle 10, reducing strain and discomfort during use. The carefully indented grooves provide optimal placement for each finger, ensuring a comfortable grip that aligns with the natural curvature of the holding hand 40. The depth and positioning of each holding groove ensure that the fingers remain securely in place during use, minimizing the risk of slippage. This is particularly beneficial for exercises that require sustained pressure or force, as the grooves help the user maintain a firm and stable grip.

Referring to FIGS. 4 and 5 of the drawings, each holding groove is symmetrical along the circumference of the front operation handle 10, the coverage of each holding groove allows a tip end portion of each corresponding finger to be bent along the holding groove, so as to allow the tip end portion of each finger to be griped on two opposite sides of the corresponding holding groove, so as to enhance the grip of each finger on the front operation handle 10. Accordingly, this symmetry creates a uniform surface for each finger to rest, ensuring an even and comfortable grip. The depth and curvature of each groove are designed to allow the tip end portion of the fingers to bend comfortably. As the fingers naturally curl around the front operation handle 10, the tip end portion of each finger makes contact with two opposite sides of the corresponding holding groove, so that the design increases the surface contact between the fingers and the front operation handle 10. This results in a firmer, more secure hold on the front operation handle 10.

The symmetrical design and coverage of the holding grooves along the circumference of the front operation handle 10 ensures that the tip end of each finger is fully engaged during gripping. By naturally bending along the corresponding knuckles and contacting two opposite sides of the corresponding holding groove, each of the fingers achieve a stronger grip, reducing slippage during use.

As shown in FIG. 4, the front operation handle 10 comprises a first groove profile surface 11 defining the first holding groove 101, a second groove profile surface 12 defining the second holding groove 102, a third groove profile surface 13 defining the third holding groove 103, and a fourth groove profile surface 14 defining the fourth holding groove 104.

The first groove profile surface 11 is preferred to be symmetrical along a first middle line 111, the second groove profile surface 12 is preferred to be symmetrical along a second middle line 121, the third groove profile surface 13 is preferred to be symmetrical along a third middle line 131, and the fourth groove profile surface 14 is preferred to be symmetrical along a fourth middle line 141, when the four fingers are gripped on the front operation handle 10, the index finger 42 is having contact with the two surface portions of the first groove profile surface 11 on two sides of the first middle line 111, the middle finger 43 is having contact with the two surface portions of the second groove profile surface 12 on two sides of the second middle line 121, the ring finger 44 is having contact with the two surface portions of the third groove profile surface 13 on two sides of the third middle line 131, and the pinky finger 45 is having contact with the two surface portions of the fourth groove profile surface 14 on two sides of the fourth middle line 141.

As shown in FIG. 4 of the drawings, the front operation handle 10 comprises a first partition ridge 105, a second partition ridge 106 and a third partition ridge 107, and a bottom partition ridge 108, the first holding groove 101 and the first groove profile surface 11 are define between the bottom of the base arm 36 and the first partition ridge 105, the second holding groove 102 and the second groove profile surface 12 are defined between the first partition ridge 105 and the second partition ridge 106, the third holding groove 103 and the third groove profile surface 13 are defined between the second partition ridge 106 and the third partition ridge 107, the fourth holding groove 104 and the fourth groove profile surface 14 are defined between the third partition ridge 107 and the bottom partition ridge 108.

In this embodiment, the first middle line 111 is a curve line having a first central contact position 112, the second middle line 121 is a curve line having a second central contact position 122, the third middle line 131 is a curve line having a third central contact position 132, the fourth middle line 141 is a curve line having a fourth central contact position 142. The first central contact position 112 is positioned backward compared with the second central contact position 122, so that the gripping position of the index finger 42 in the first holding groove 101 is positioned backward compared with the middle finger 43 in the second holding groove 102. The fourth central position 142 is positioned backward compared with the third central contact position 132, so that the pinky finger 45 in the fourth holding groove 104 is positioned backward compared with the ringer finger 44 in the third holding groove 103, so as to reduce the stretching distances of the short index finger 42 and the pinky finger 45, and ensure that the tip end portions of the index finger 42 and the pinky finger 45 can grip on two sides of the corresponding middle line.

By positioning the first and fourth central contact positions 112 and 142 backward, the design reduces the need for excessive stretching of the shorter index finger 42 and pinky finger 45. This leads to a more natural grip where all fingers can apply equal force, enhancing user comfort and minimizing fatigue during extended use.

Each finger grips along two surface portions of its corresponding groove profile surface, maximizing contact and providing better control. This results in a stronger, more stable grip on the front operation handle 10, improving performance during use, especially for strength training exercises.

The varying positions of the central contact points along the curved middle lines accommodate the natural differences in finger length. The design ensures that each finger, from the index to the pinky, can grip effectively, without causing strain or requiring uncomfortable stretching.

The partition ridges 105, 106, 107 and 108 ensure that each finger is securely placed in its respective holding groove 101, 102, 103 and 104, preventing slippage or misalignment. This separation allows the user to easily maintain correct finger positioning, ensuring consistent grip and minimizing hand fatigue.

The symmetrical design of each groove profile surface 11, 12, 13 and 14 allows the fingers to grip evenly on both sides of the corresponding middle line. This symmetry helps balance the force applied by each finger, ensuring that the grip is both strong and comfortable, and the natural curling motion of each finger gripped on the corresponding groove profile surface reduces strain on the finger and enhances the overall grip strength, making the ergonomic hand grip strengthener more effective in building hand and finger strength.

In this embodiment, the front operation handle 10 comprises an upper handle portion 15 and a lower handle portion 16, the upper handle portion 15 is a portion above the second partition ridge 106, the lower handle portion 16 is a portion below the second partition ridge 106. The upper handle portion 15 is gradually protruding frontward along a direction toward the second partition ridge 106, the lower handle portion 16 is gradually protruding frontward along a direction toward the second partition ridge 106, so that the curvature of the front operation handle 10 is conforming to the ergonomic holding of the four fingers 42, 43, 44 and 45.

The gradual protrusion of both handle portions 15 and 16 creates a curvature that conforms to the natural shape of the fingers 42, 43, 44 and 45 of the holding hand 40 of the user. This ergonomic feature enhances comfort during use, reducing strain on the hand.

As shown in FIG. 4 and FIG. 5 of the drawings, the gradual protrusion of both handle portions 15 and 16 allows a second central position 1061 of the second partition ridge 106 to be positioned in front of a first central position 1051 of the first partition ridge 105 and a third central position 1071 of the third partition ridge 107. In other words, compared to the second central position 1061 of the second partition ridge 106, the first central position 1051 of the first partition ridge 105 and the third central position 1071 of the third partition ridge 107 are positioned backward, so as to adjust the placement positions of the index finger 42 and the pinky finger 45 to be backward, so as to prevent the index finger 42 and the pinky finger 45 to stretch excessively, and ensure that the tip end portion of each of the two fingers is able to bend and abut against the two opposite surface portions of the corresponding groove profile surface.

In this embodiment, the front operation handle 10 comprises a rear extension surface 109 which comprises an upper extension surface section 1091 and a lower extension surface section 1092 for defining an indented groove 1093 at a rear side of the front operation handle 10.

The upper extension surface section 1091 is gradually protruding frontward along a direction towards the lower handle portion 16 away from the base arm 36, the lower extension surface section 1092 is gradually protruding frontward along a direction towards the upper handle portion 15 away from the bottom of the front operation handle 10. Accordingly, along a direction from top to bottom, a curve of the rear extension surface 109 protrude first, and then recede backward, so as to create a convex shape, so that the front operation handle 10 is configured to allow the upper handle portion 15 to be gradually protruding frontward along a direction toward the second partition ridge 106 and to allow the lower handle portion 16 to be gradually protruding frontward along a direction toward the second partition ridge 106.

The rear operation handle 20 comprises a front surface 203 which can be a straight flat surface that is extended along a vertical direction, as shown in FIG. 4 of the drawings, a movement space 204 is thus created between the front surface 203 of the rear operation handle 20 and the rear extension surface 109 of the front operation handle 10, so as to allow the approaching movement between the front operation handle 10 and the rear operation handle 20. The creation of this movement space 204 ensures that there is enough clearance for the handles 10 and 20 to move towards each other without interference, facilitating the pivotal movement necessary for the operation of the ergonomic hand grip strengthener.

Furthermore, the first holding groove 101 has a first width W1 defined between the bottom of the base arm 36 and the first partition ridge 105, the second holding groove 102 has a second width W2 defined between the first partition ridge 105 and the second partition ridge 106, the third holding groove 103 has a third width W3 defined between the second partition ridge 106 and the third partition ridge 107, the fourth holding groove 104 has a fourth width W4 defined between the third partition ridge 107 and the bottom partition ridge 108. Preferably, the widths of the four holding grooves are different, so as to conform to different dimensions of the fingers 42, 43, 44 and 45.

More specifically, as a preferred example, the first width W1 of the first holding groove 101 is larger than the second width W2 of the second holding groove 102, the second width W2 of the second holding groove 102 is larger than the third width W3 of the third holding groove 103, the third width W3 of the third holding groove 102 is larger than the fourth width W4 of the fourth holding groove 104. Accordingly, the index finger 42 which has a larger dimension is provided with the first holding groove 101 with the largest first width W1, the pinky finger 45 which has a smaller dimension is provided with the fourth holding groove 104 with the smallest fourth width W4.

The widths of the four holding grooves 101, 102, 103 and 104 are intentionally designed to differ, accommodating the varying dimensions of the fingers 42, 43, 44 and 45. This tailored approach enhances comfort and functionality during use. By providing holding grooves 101, 102, 103 and 104 that correspond to the natural widths of the fingers 42, 43, 44 and 45, the design minimizes discomfort and allows for a more secure grip. The user can grip the handle with their fingers bent comfortably, enhancing overall control during exercise. The tailored widths promote better stability as each finger fits snugly into its respective holding groove, reducing slippage and improving grip strength during use.

It is worth mentioning that the four holding grooves 101, 102, 103 and 104 can be formed by an arm main body of the front operation handle 10, or the front operation handle 10 comprises a front resilient cover which is covered on the arm main body of the front operation handle 10 to form the four holding grooves 101, 102, 103 and 104.

Figure 7A:
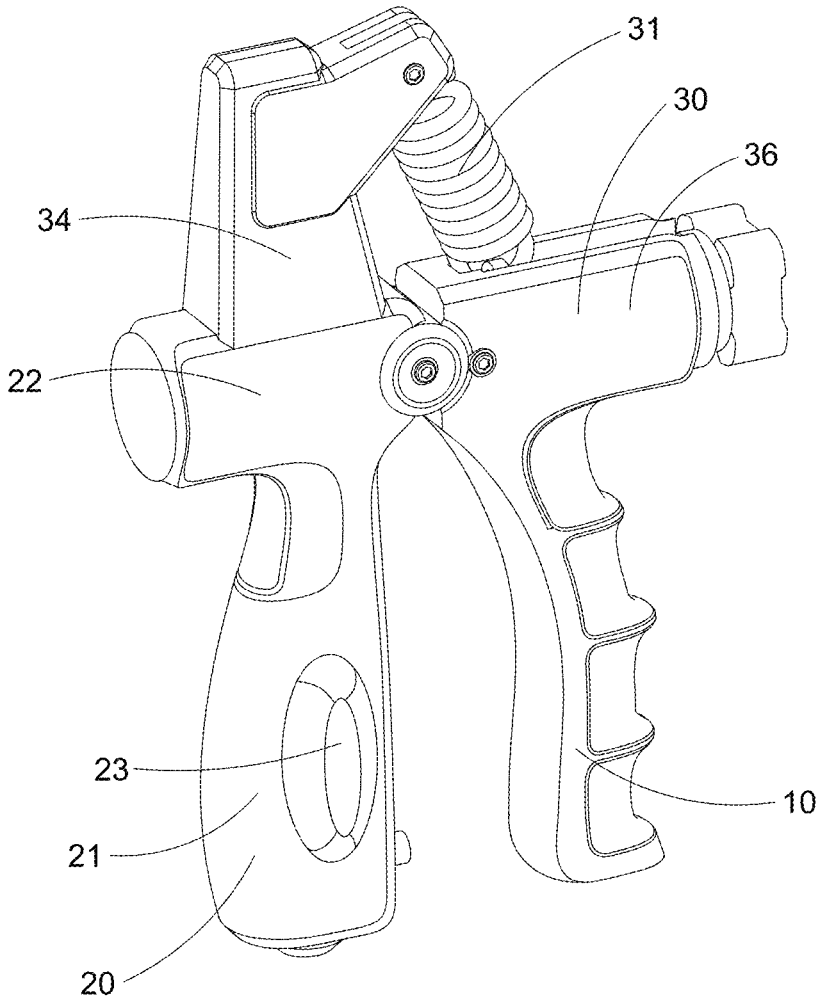
FIG. 7A is a perspective view illustrating an alternative rear operation handle of the ergonomic hand grip strengthener according to the above first preferred embodiment of the present invention.
Figure 7B:
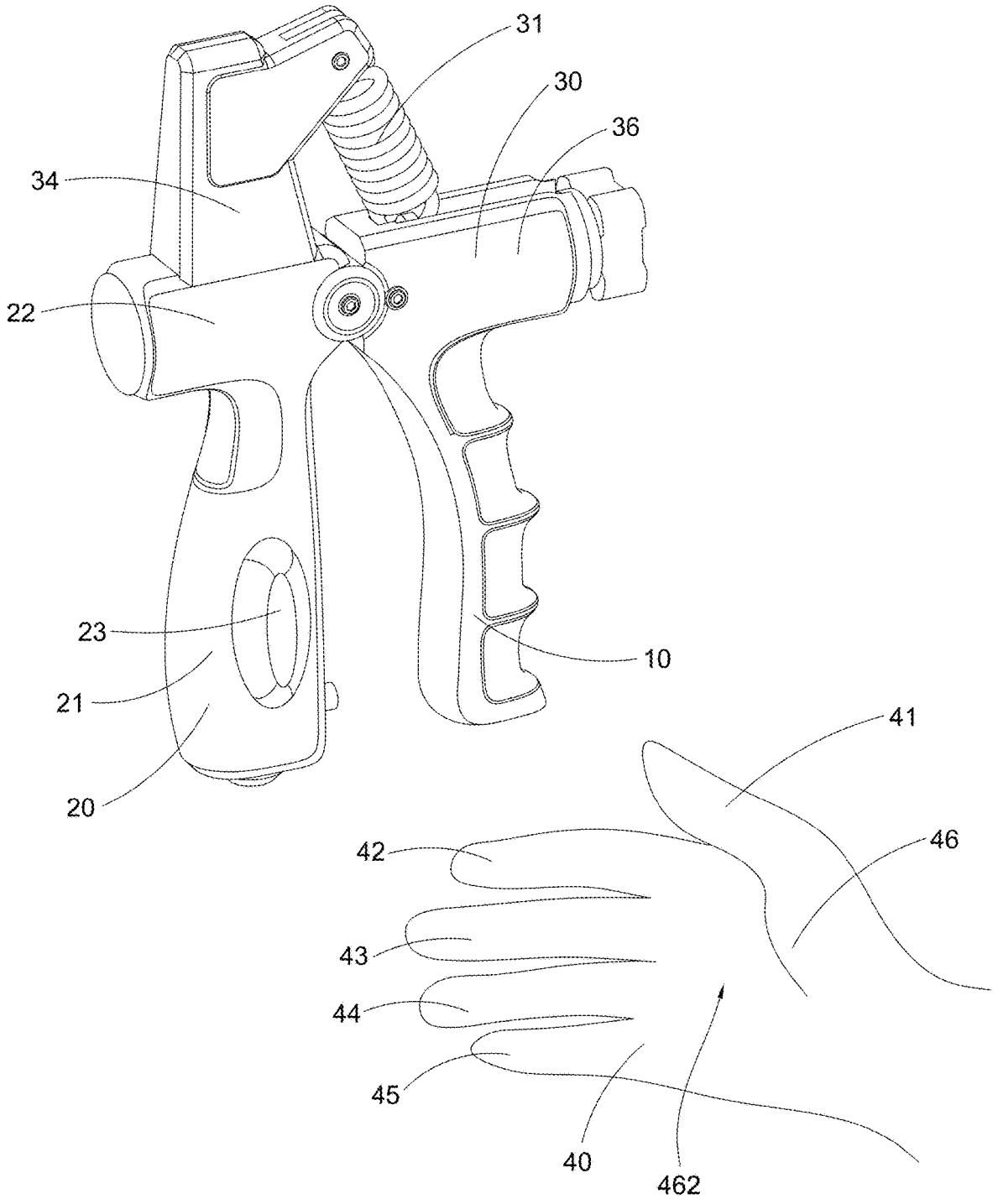
FIG. 7B is a perspective view illustrating the alternative rear operation handle of the ergonomic hand grip strengthener being conforming with the palm of the holding hand of the user according to the above first preferred embodiment of the present invention.

Referring to FIG. 7A and FIG. 7B of the drawings, the rear operation handle 20 may further comprise a protrusion part 23 which is protruded from a side of the arm body 21 for conforming to the palm 46 of the holding hand 40 of the user. When the holding hand 40 is holding on the ergonomic hand grip strengthener, with reference to FIG. 7B, a central area of the palm 46 will be naturally bent to form an intended groove 462, the protrusion part 23 is at a position corresponding to the intended groove 462 of the palm 46, so as to naturally and ergonomically support the palm 46.

According to this embodiment, the protrusion part 23 is strategically positioned to fit into the natural groove 462 formed in the center of the palm 46 when gripping the rear operation handle 20. This allows the hand grip strengthener to conform more closely to the user's hand anatomy, providing consistent support throughout the gripping process.

By filling the groove 462 of the palm 46, the protrusion part 23 creates a snug fit, preventing the rear operation handle 20 from moving or slipping in the holding hand 40 even during intense or repetitive use. Therefore, by engaging with the natural groove 462 in the palm 46, the protrusion part 23 anchors the rear operation handle 20 more securely in the holding hand 40, this results in greater stability during gripping exercises.

Figure 7C:
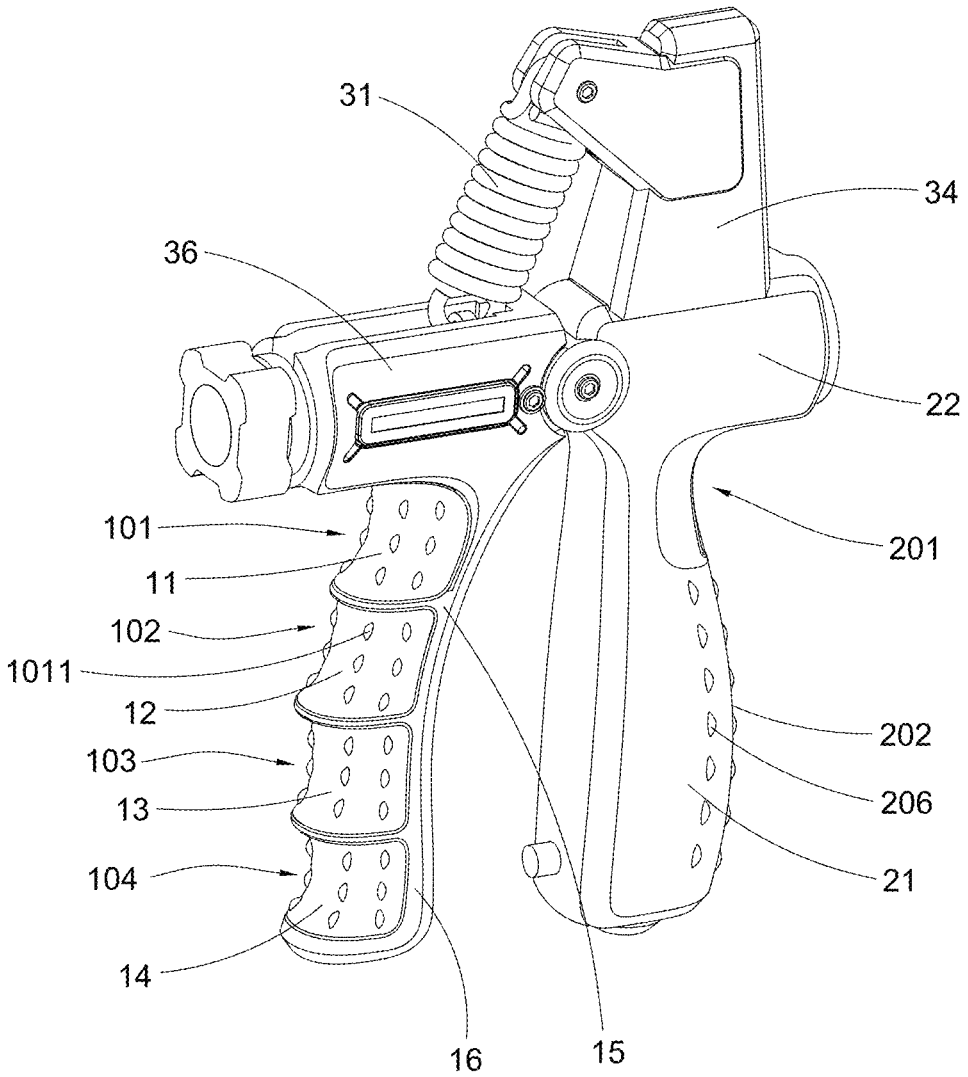
FIG. 7C is a perspective view illustrating another alternative operation handles of the ergonomic hand grip strengthener according to the above first preferred embodiment of the present invention.
Figure 8:
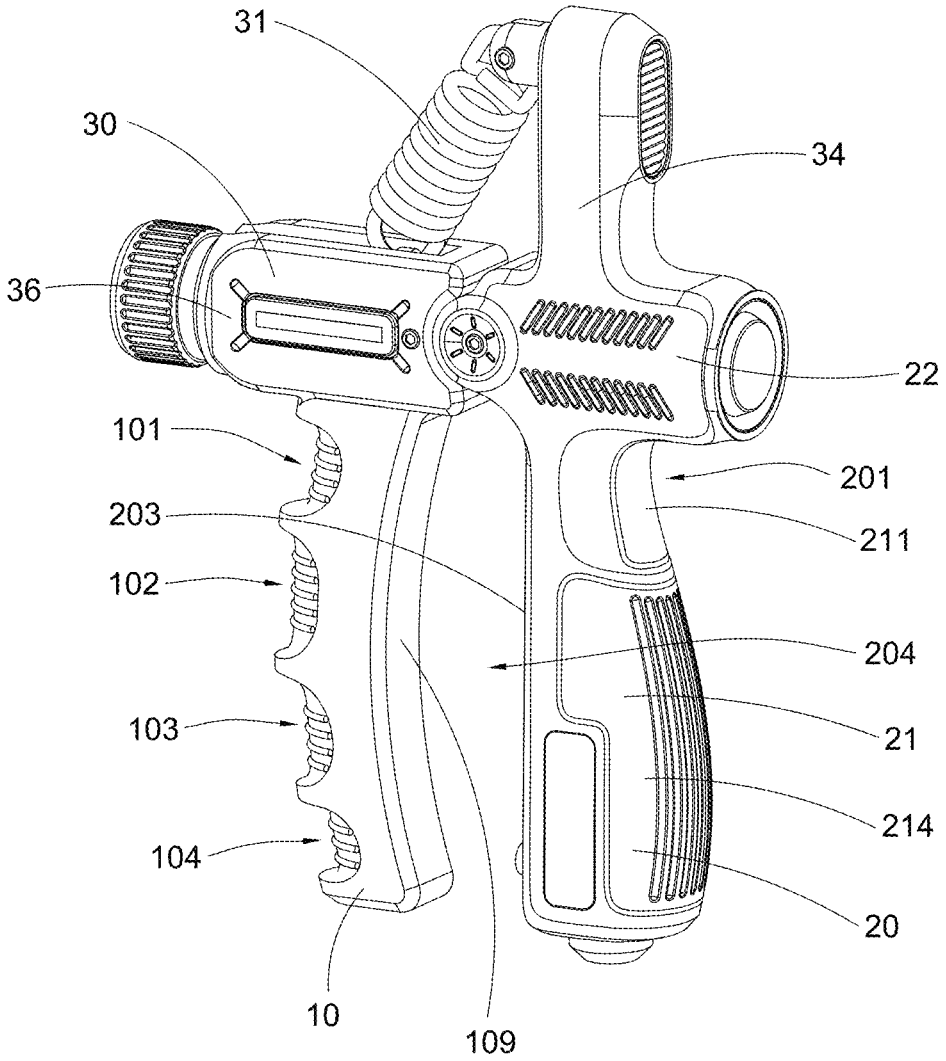
FIG. 8 is a perspective view of an ergonomic hand grip strengthener according to a first alternative mode of the above first preferred embodiment of the present invention.
Figure 9:
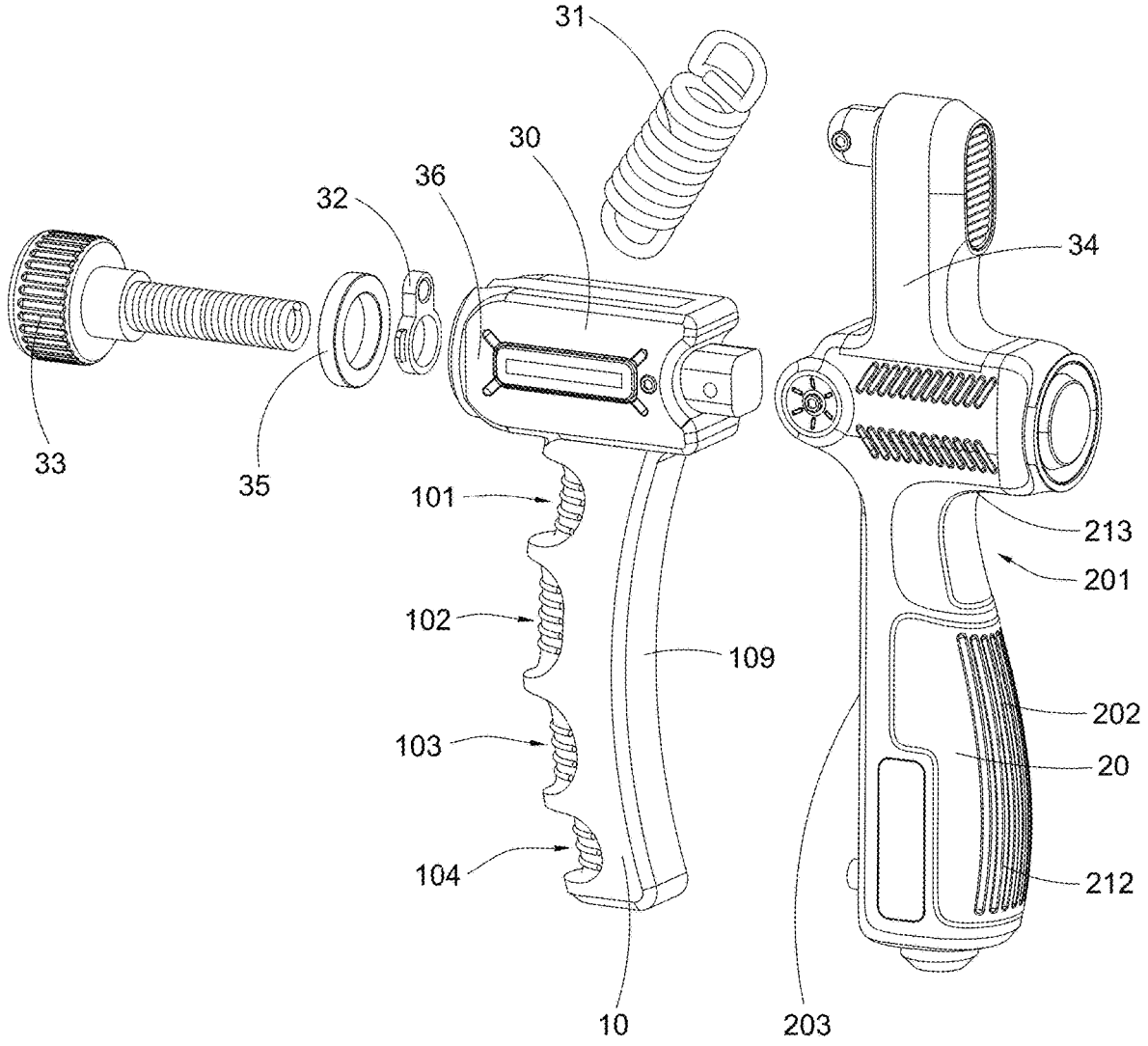
FIG. 9 is an exploded view of the ergonomic hand grip strengthener according to the first alternative mode of the above first preferred embodiment of the present invention.

As shown in FIG. 7C, as an alternative mode, both of the two operation handles 10 and 20 can be further provided with a plurality of resilient protrusions for enhancing a hand massaging effect when the holding hand 40 of the user is griped on the two operation handles 10 and 20 for hand grip training.

The resilient protrusions can be formed on the engaging surfaces of the two operation handles 10 and 20 which are having contact with the holding hand 40 of the user. More specifically, the front operation handle 10 comprises a plurality of first resilient protrusions 1011 formed on at least a front surface thereof, the rear operation handle 20 comprises a plurality of second resilient protrusions 206 formed on at least the rear abutting surface 202 thereof.

Referring to FIG. 7C, the plurality of first resilient protrusions 1011 can be formed in the four holding grooves 101, 102, 103 and 104 on the four grove profile surfaces 11, 12, 13 and 14. The plurality of second resilient protrusions 206 can be formed on the rear abutting surface 202 as well as a side surface of the rear operation handle 20 facing toward the palm 46 of holding hand 40 of the user.

By incorporating resilient protrusions 1011 and 206 on the operation handles, the ergonomic hand grip strengthener offers a massaging effect during use. As the holding hand 40 of the user grips on the operation handles 10 and 20, the resilient protrusions 1011 and 206 exert pressure on different areas of the holding hand 40, creating a dynamic massage that targets specific points on the palm 46 and fingers 41, 42, 43, 44 and 45.

This massaging action can help relieve tension and stimulate blood circulation in the holding hand 40, promoting overall hand health while still achieving the desired muscle-strengthening benefits. This dual functionality not only makes the ergonomic grip strengthener more effective but also more appealing for users seeking both exercise and relaxation.

Referring to FIGS. 8 to 11 of the drawings, an ergonomic hand grip strengthener according to a first alternative mode of the above first preferred embodiment of the present invention is illustrated, the ergonomic hand grip strengthener comprises a front operation handle 10, a rear operation handle 20, and a strength adjustment assembly 30 for adjusting the resistance applied to the approaching movement of the front operation handle 10 and the rear operation handle 20.

In this embodiment, the front operation handle 10 has a first holding groove 101, a second holding groove 102, a third holding groove 103 and a fourth holding groove 104 which are respectively define by a first groove profile surface 11, a second groove profile surface 12, a third groove profile surface 13 and a fourth groove profile surface 14.

The first groove profile surface 11 is preferred to be symmetrical along a first middle line 111, the second groove profile surface 12 is preferred to be symmetrical along a second middle line 121, the third groove profile surface 13 is preferred to be symmetrical along a third middle line 131, and the fourth groove profile surface 14 is preferred to be symmetrical along a fourth middle line 141, when the four fingers are gripped on the front operation handle 10, the index finger 42 is having contact with the two surface portions of the first groove profile surface 11 on two sides of the first middle line 111, the middle finger 43 is having contact with the two surface portions of the second groove profile surface 12 on two sides of the second middle line 121, the ring finger 44 is having contact with the two surface portions of the third groove profile surface 13 on two sides of the third middle line 131, and the pinky finger 45 is having contact with the two surface portions of the fourth groove profile surface 14 on two sides of the fourth middle line 141.

In this embodiment, the first middle line 111 is a curve line having a first central contact position 112, the second middle line 121 is a curve line having a second central contact position 122, the third middle line 131 is a curve line having a third central contact position 132, the fourth middle line 141 is a curve line having a fourth central contact position 142. The first central contact position 112 is positioned backward compared with the second central contact position 122, so that the gripping position of the index finger 42 in the first holding groove 101 is positioned backward compared with the middle finger 43 in the second holding groove 102. The third central contact position 132 is positioned backward compared with the second central contact position 122, so that the gripping position of the ring finger 44 in the third holding groove 103 is positioned backward compared with the middle finger 43 in the second holding groove 102, the fourth central position 142 is positioned backward compared with the third central contact position 132, so that the pinky finger 45 in the fourth holding groove 104 is positioned backward compared with the ringer finger 44 in the third holding groove 103. Accordingly, the middle finger 44 can be placed at a foremost position, and the stretching distances of the short index finger 42 and the pinky finger 45 can be reduced.

In addition, resilient materials can be disposed in the four holding grooves 101, 102, 103 and 104 for the resilient contact with the corresponding fingers 42, 43, 44 and 45.

In this embodiment, the rear operation handle 20 has a concave groove 201 and comprises a rear abutting surface 202 under the connecting arm 22 for abutting the holding hand 40 of the user. The rear abutting surface 202 comprises a top abutting surface section 2021 for abutting against the back of the thumb 41 and the upper edge portion 461 of the palm 46, a thumb abutting surface section 2022 for abutting an inner surfaces of the thumb 41 and the upper edge portion 461 of the palm 46, a palm abutting surface section 2023 for abutting against the palm 46 of the holding hand.

The arm body 21 of the rear operation handle 20 comprises an upper resilient cover 213 disposed in the concave groove 201 for defining the top abutting surface section 2021 and the thumb abutting surface section 2022, and lower resilient cover 214 for defining the palm abutting surface section 2023. The cushioning of the resilient covers helps maintain a secure hold, preventing slippage and promoting better control of the strengthener.

Figure 10:
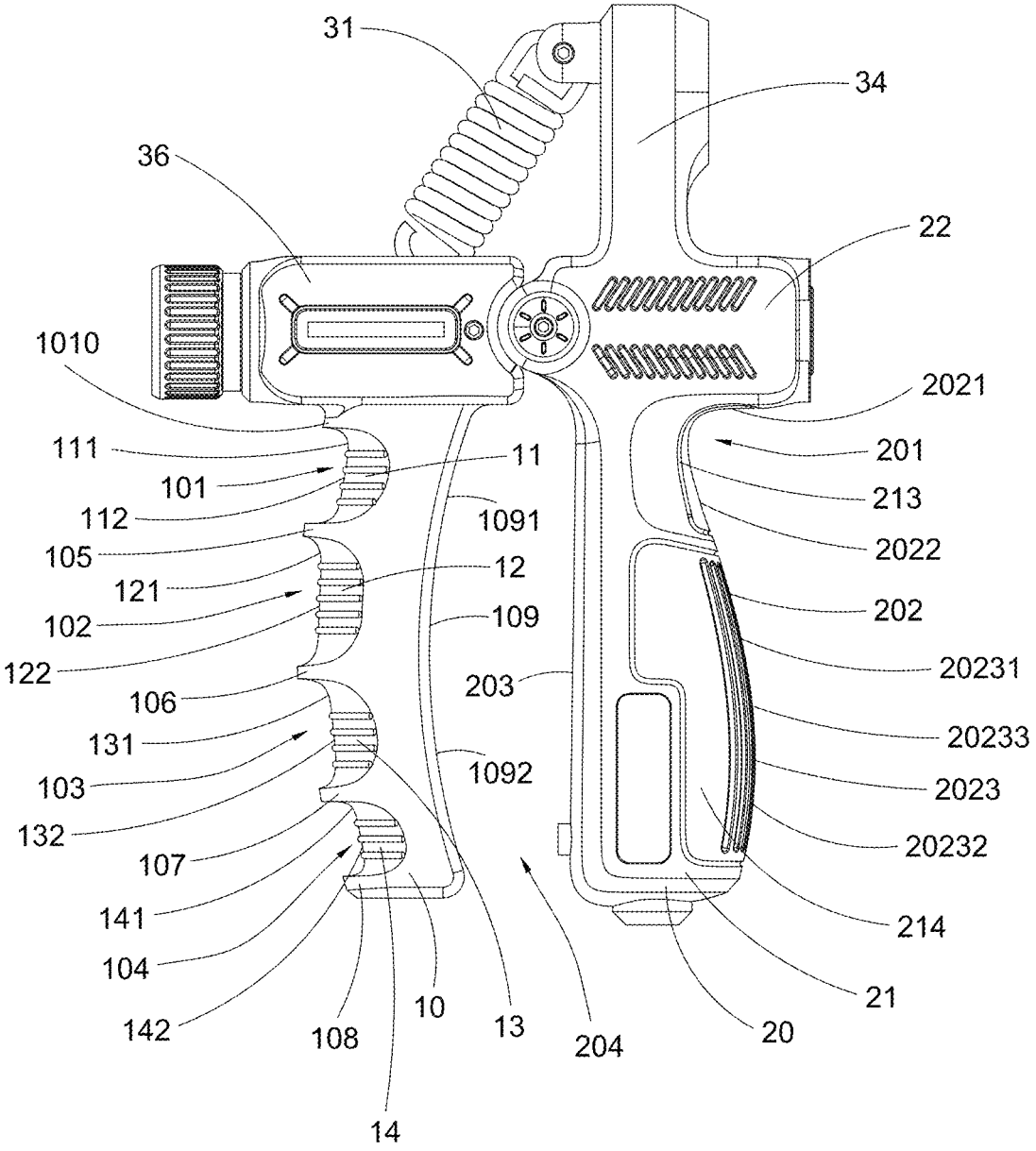
FIG. 10 is a side schematic view of the ergonomic hand grip strengthener according to the first alternative mode of the above first preferred embodiment of the present invention.
Figure 11:
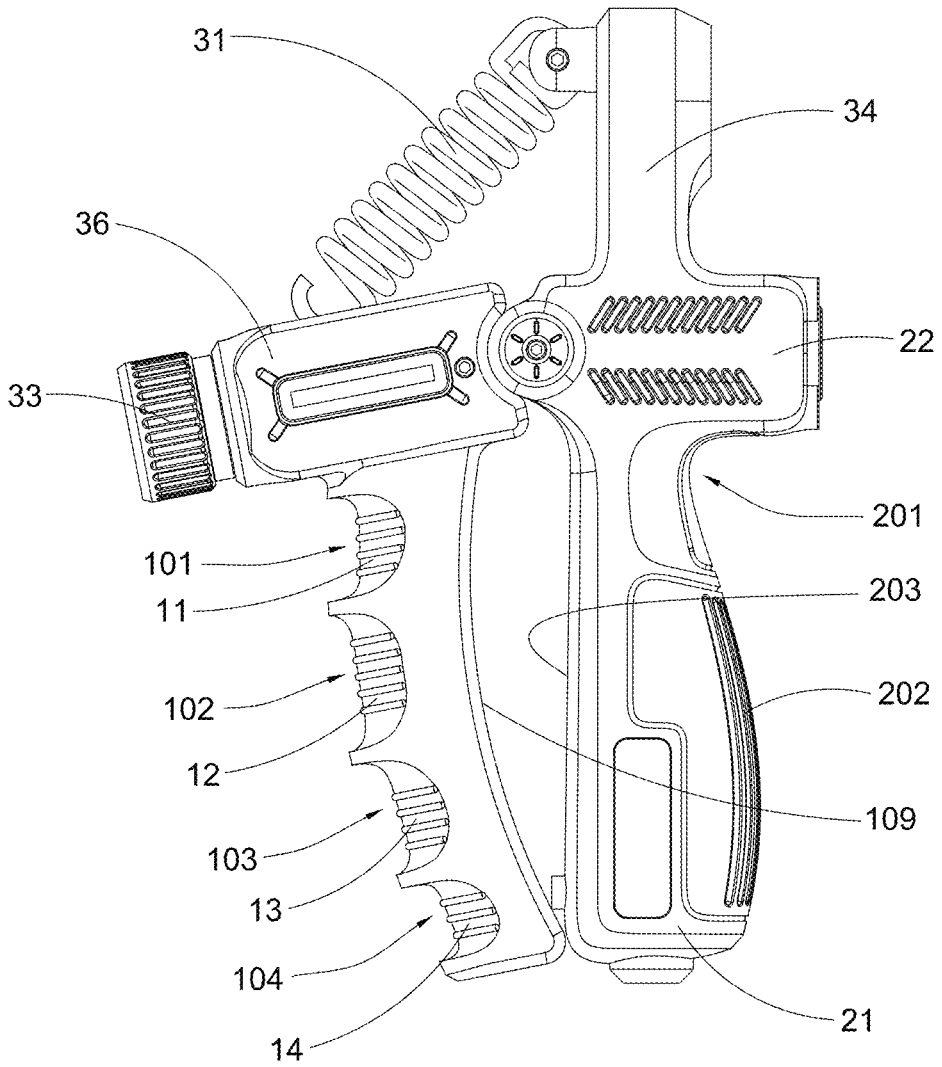
FIG. 11 is a side schematic view illustrating two operation handles of the ergonomic hand grip strengthener being approached to each other according to the first alternative mode of the above first preferred embodiment of the present invention.

With reference to FIG. 10 and FIG. 11 of the drawings, it is can be seen that a distance between a bottom of the front operation handle 10 and a front surface 203 of the rear operation handle 20 defines the largest movement distance between the front operation handle 10 and the rear operation handle 20.

Figure 12:
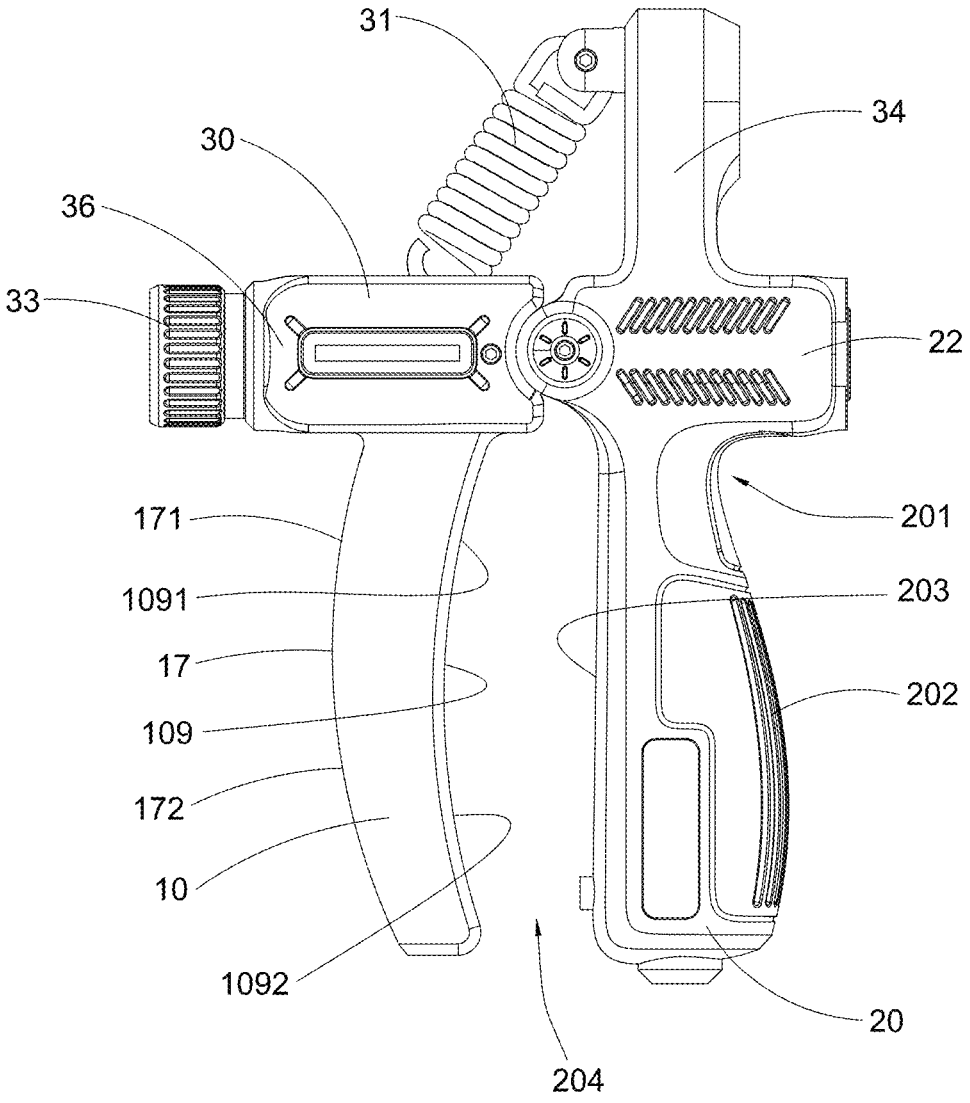
FIG. 12 is a perspective view of an ergonomic hand grip strengthener according to a second alternative mode of the above first preferred embodiment of the present invention.

Referring to FIG. 12 of the drawings, an ergonomic hand grip strengthener according to a second alternative mode of the above first preferred embodiment of the present invention is illustrated, the ergonomic hand grip strengthener comprises a front operation handle 10, a rear operation handle 20, and a strength adjustment assembly 30 for adjusting the resistance applied to the approaching movement of the front operation handle 10 and the rear operation handle 20.

In this embodiment, the rear operation handle 20 is configured to have structure similar to the above embodiment, the front operation handle 10 is not formed with the above holding grooves 101, 102, 103, and 104, but comprises a front abutting surface 17 which comprises an upper surface section 171 and a lower surface section 172 integrally extended from the upper surface section 171 to form a convex shape. The upper surface section 171 is gradually protruding forward along a direction toward the bottom of the front operation handle 10 away from the base arm 36, the lower surface section 172 is gradually protruding forward along a direction toward the base arm 36 away from the bottom of the front operation handle 10 until the upper surface section 171 and the lower surface section 172 are converged at a middle peak protruding position.

The index finger 42 and the middle finger 43 of the holding hand 40 can abut against the upper surface 171 while the ring finger 44 and the pinky finger 45 can abut against the lower surface section 172, so that the stretching distances of the index finger 42 and the pinky finger 45 can be reduced.

The design of both the upper and lower surface sections 171 and 172 ensures that the stretching distances of the index finger 44 and pinky finger 45 are minimized. This is particularly important for the smaller pinky finger, allowing it to abut comfortably without excess strain. The convex shape of the front abutting surface 17 offers a natural curve that conforms to the shape of the holding hand 40, distributing pressure evenly across the fingers 42, 43, 44 and 45. This design helps in maintaining a strong and secure grip, reducing hand fatigue over time.

Figure 13:
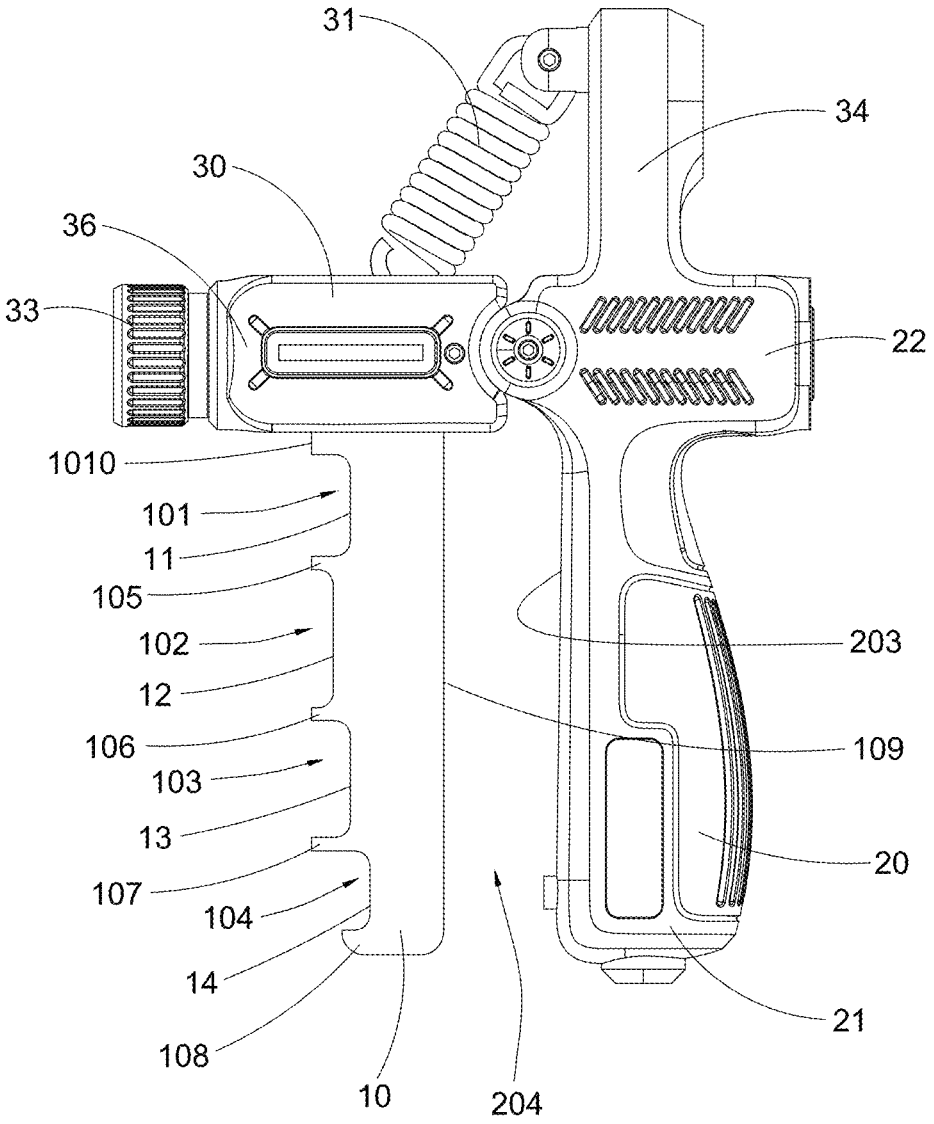
FIG. 13 is a perspective view of an ergonomic hand grip strengthener according to a third alternative mode of the above first preferred embodiment of the present invention.

Referring to FIG. 13 of the drawings, an ergonomic hand grip strengthener according to a third alternative mode of the above first preferred embodiment of the present invention is illustrated, the ergonomic hand grip strengthener comprises a front operation handle 10, a rear operation handle 20, and a strength adjustment assembly 30 for adjusting the resistance applied to the approaching movement of the front operation handle 10 and the rear operation handle 20.

In this embodiment, the rear operation handle 20 is configured to have structure similar to the above embodiment, the front operation handle 10 comprise a rear extension surface 209 which can be a straight and flat surface. The front operation handle 10 has a first holding groove 101, a second holding groove 102, a third holding groove 103 and a fourth holding groove 104 which are respectively define by a first groove profile surface 11, a second groove profile surface 12, a third groove profile surface 13 and a fourth groove profile surface 14.

The front operation handle 10 comprises a top partition ridge 1010, a first partition ridge 105, a second partition ridge 106 and a third partition ridge 107, and a bottom partition ridge 108, the first holding groove 101 and the first groove profile surface 11 are define between the top partition ridge 1010 and the first partition ridge 105, the second holding groove 102 and the second groove profile surface 12 are defined between the first partition ridge 105 and the second partition ridge 106, the third holding groove 103 and the third groove profile surface 13 are defined between the second partition ridge 106 and the third partition ridge 107, the fourth holding groove 104 and the fourth groove profile surface 14 are defined between the third partition ridge 107 and the bottom partition ridge 108.

In this embodiment, the second holding groove 102 is at a foremost position compared with the other three holding grooves 101, 103 and 104. Accordingly, the second holding groove 102 is positioned more forward than the first holding groove 101, the third holding groove 103 is positioned further back than the second holding groove 102, and the fourth holding groove 104 is positioned further back than the third holding groove 103.

Figure 14:
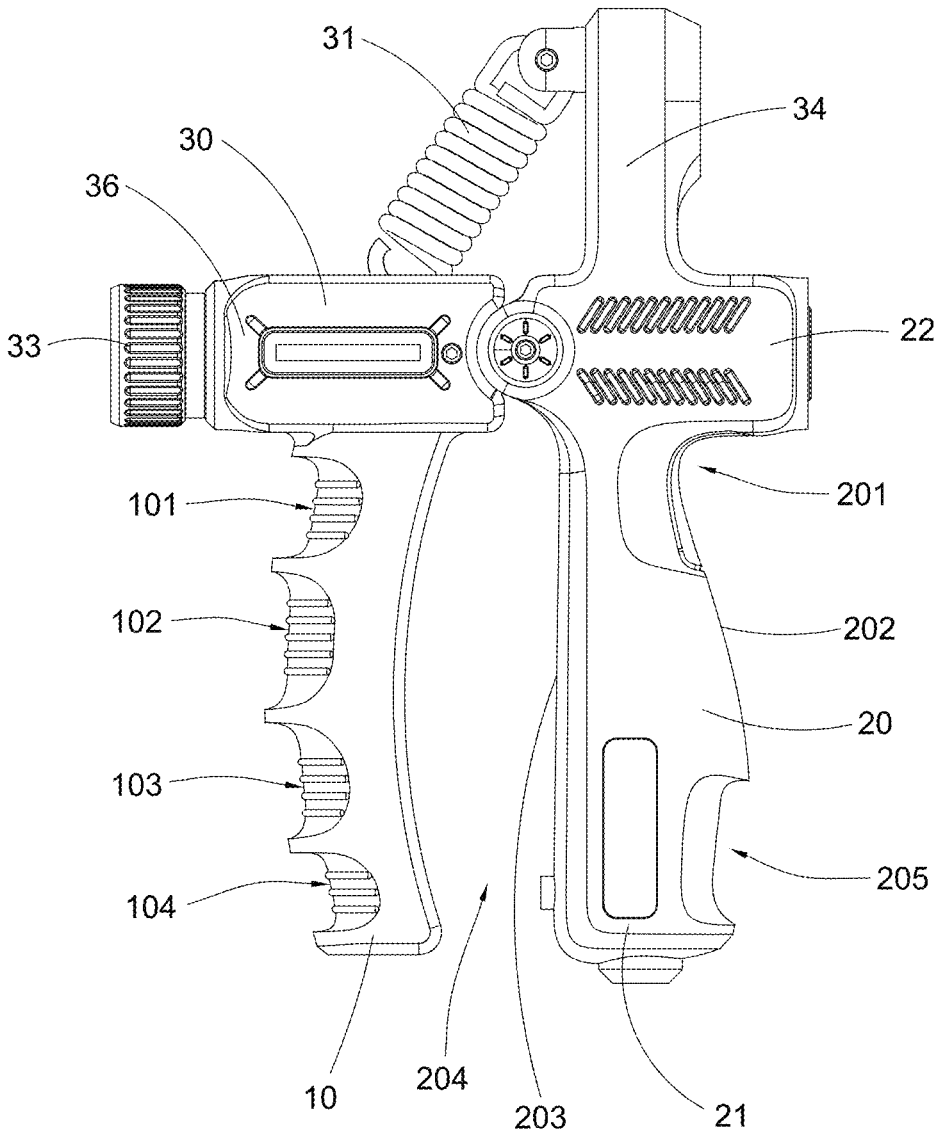
FIG. 14 is a perspective view of an ergonomic hand grip strengthener according to a fourth alternative mode of the above first preferred embodiment of the present invention.
Figure 15:
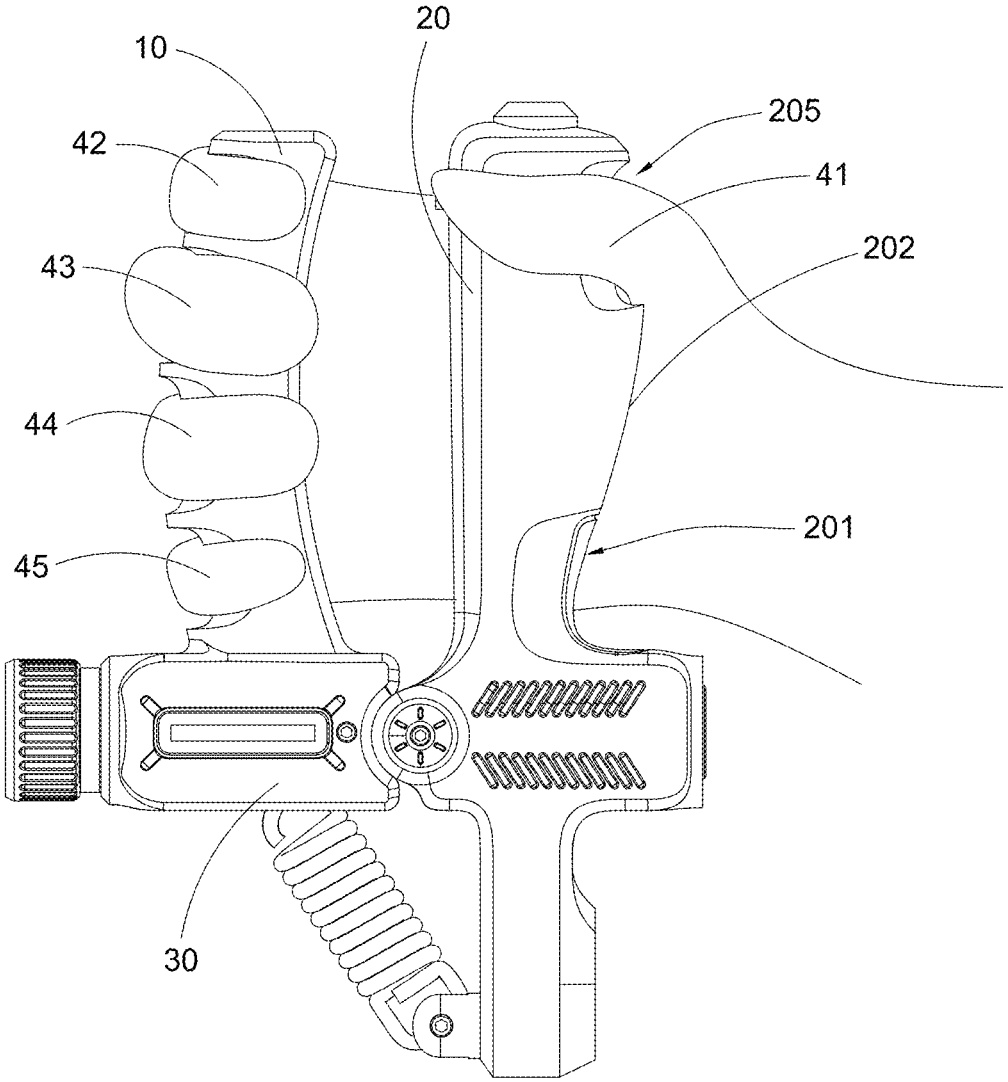
FIG. 15 is a perspective view illustrating the ergonomic hand grip strengthener being held in the holding hand of the user according to a fourth alternative mode of the above first preferred embodiment of the present invention.

Referring to FIGS. 14 and 15 of the drawings, an ergonomic hand grip strengthener according to a fourth alternative mode of the above first preferred embodiment of the present invention is illustrated, the ergonomic hand grip strengthener comprises a front operation handle 10, a rear operation handle 20, and a strength adjustment assembly 30 for adjusting the resistance applied to the approaching movement of the front operation handle 10 and the rear operation handle 20. In this embodiment, the rear operation handle 20 is formed with a lower concave groove 205.

As shown in FIG. 15, the ergonomic hand grip strengthener can be upside down during use, and the thumb 41 can be placed at the lower concave groove 205 while the rest four fingers 42, 43, 44, and 45 are placed on the front operation handle 10.

Figure 16:
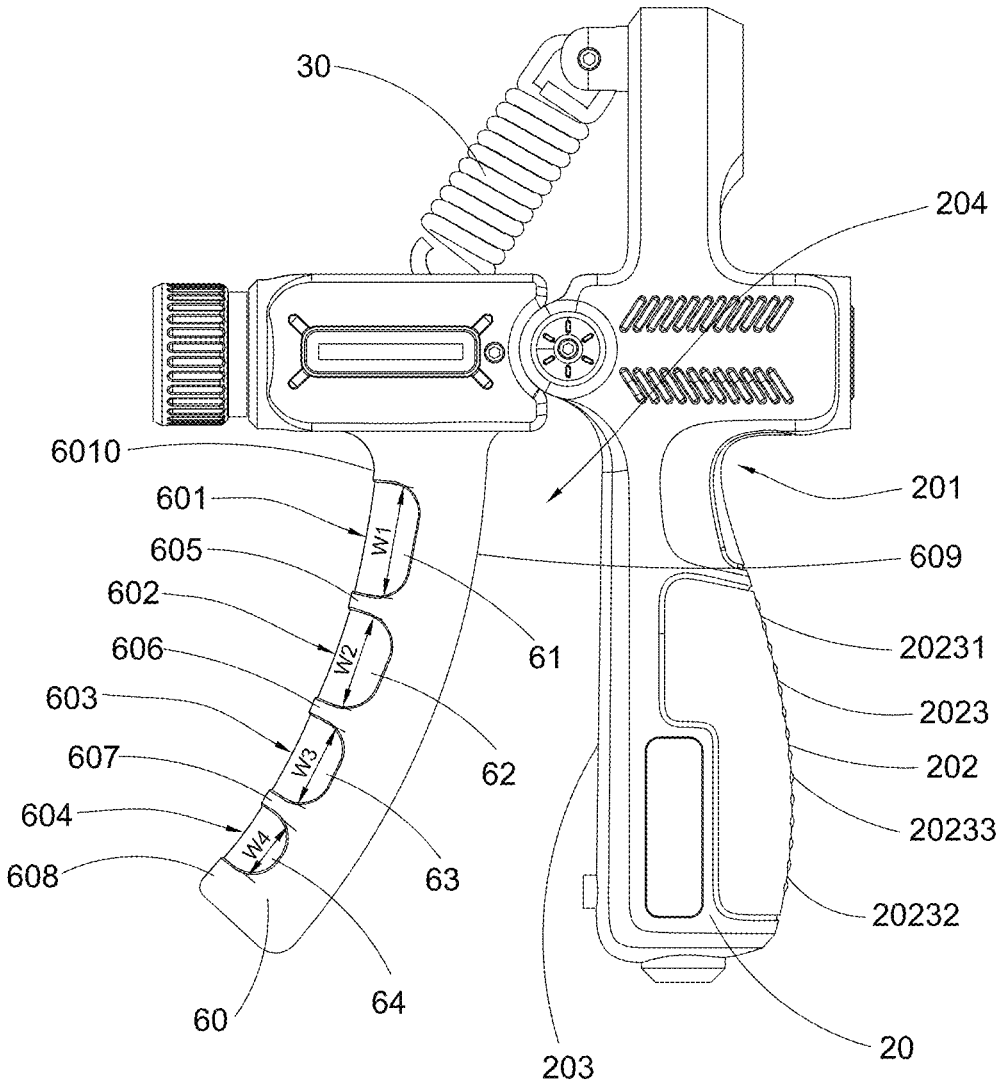
FIG. 16 is a perspective view of an ergonomic hand grip strengthener according to a second preferred embodiment of the present invention.

Referring to FIG. 16 the drawings, an ergonomic hand grip strengthener according to a second preferred embodiment of the present invention is illustrated, the ergonomic hand grip strengthener comprises a front operation handle 60, a rear operation handle 20, and a strength adjustment assembly 30 for adjusting the resistance applied to the approaching movement of the front operation handle 10 and the rear operation handle 20.

In this embodiment, the rear operation handle 20 is configured to have a structure similar to the above embodiment, has a concave groove 201 and comprises a rear abutting surface 202 under the connecting arm 22 for abutting the holding hand 40 of the user. The rear abutting surface 202 comprises a top abutting surface section 2021 for abutting against the back of the thumb 41 and the upper edge portion 461 of the palm 46, a thumb abutting surface section 2022 for abutting an inner surfaces of the thumb 41 and the upper edge portion 461 of the palm 46, a palm abutting surface section 2023 for abutting against the palm 46 of the holding hand.

The front operation handle 60 has a a first holding groove 601, a second holding groove 602, a third holding groove 603 and a fourth holding groove 604 which are respectively define by a first groove profile surface 61, a second groove profile surface 62, a third groove profile surface 63 and a fourth groove profile surface 64.

The first holding groove 601 has a first width W1 defined between a top partition ridge 6010 and a first partition ridge 605, the second holding groove 602 has a second width W2 defined between the first partition ridge 605 and the second partition ridge 606, the third holding groove 603 has a third width W3 defined between the second partition ridge 606 and the third partition ridge 607, the fourth holding groove 604 has a fourth width W4 defined between the third partition ridge 607 and the bottom partition ridge 608. Preferably, the widths of the four holding grooves are different, so as to conform to different dimensions of the fingers 42, 43, 44 and 45.

More specifically, as a preferred example, the first width W1 of the first holding groove 601 is larger than the second width W2 of the second holding groove 602, the second width W2 of the second holding groove 602 is larger than the third width W3 of the third holding groove 603, the third width W3 of the third holding groove 602 is larger than the fourth width W4 of the fourth holding groove 604. Accordingly, the index finger 42 which has a larger dimension is provided with the first holding groove 601 with the largest first width W1, the pinky finger 45 which has a smaller dimension is provided with the fourth holding groove 604 with the smallest fourth width W4.

The widths of the four holding grooves 601, 602, 603 and 604 are intentionally designed to differ, accommodating the varying dimensions of the fingers 42, 43, 44 and 45. This tailored approach enhances comfort and functionality during use. By providing holding grooves 601, 602, 603 and 604 that correspond to the natural widths of the fingers 42, 43, 44 and 45, the design minimizes discomfort and allows for a more secure grip. The user can grip the handle with their fingers bent comfortably, enhancing overall control during exercise. The tailored widths promote better stability as each finger fits snugly into its respective holding groove, reducing slippage and improving grip strength during use.

In this embodiment, the front operation handle 60 is gradually protruding frontward along a direction from top to bottom, an rear extension surface 609 can be gradually protruding outward along a direction toward the bottom of the front operation handle 60 away from the base arm 36.

Figure 17:
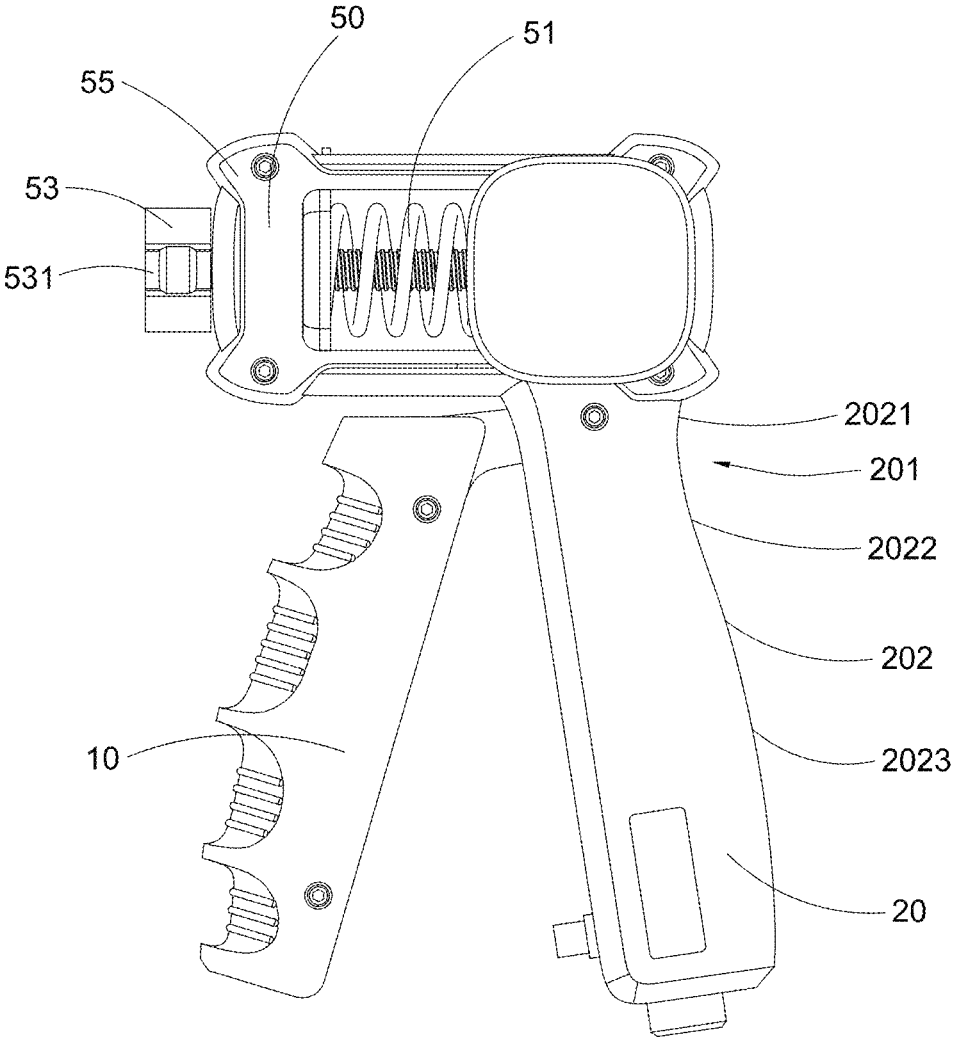
FIG. 17 is a perspective view of an ergonomic hand grip strengthener according to a third preferred embodiment of the present invention.
Figure 18:
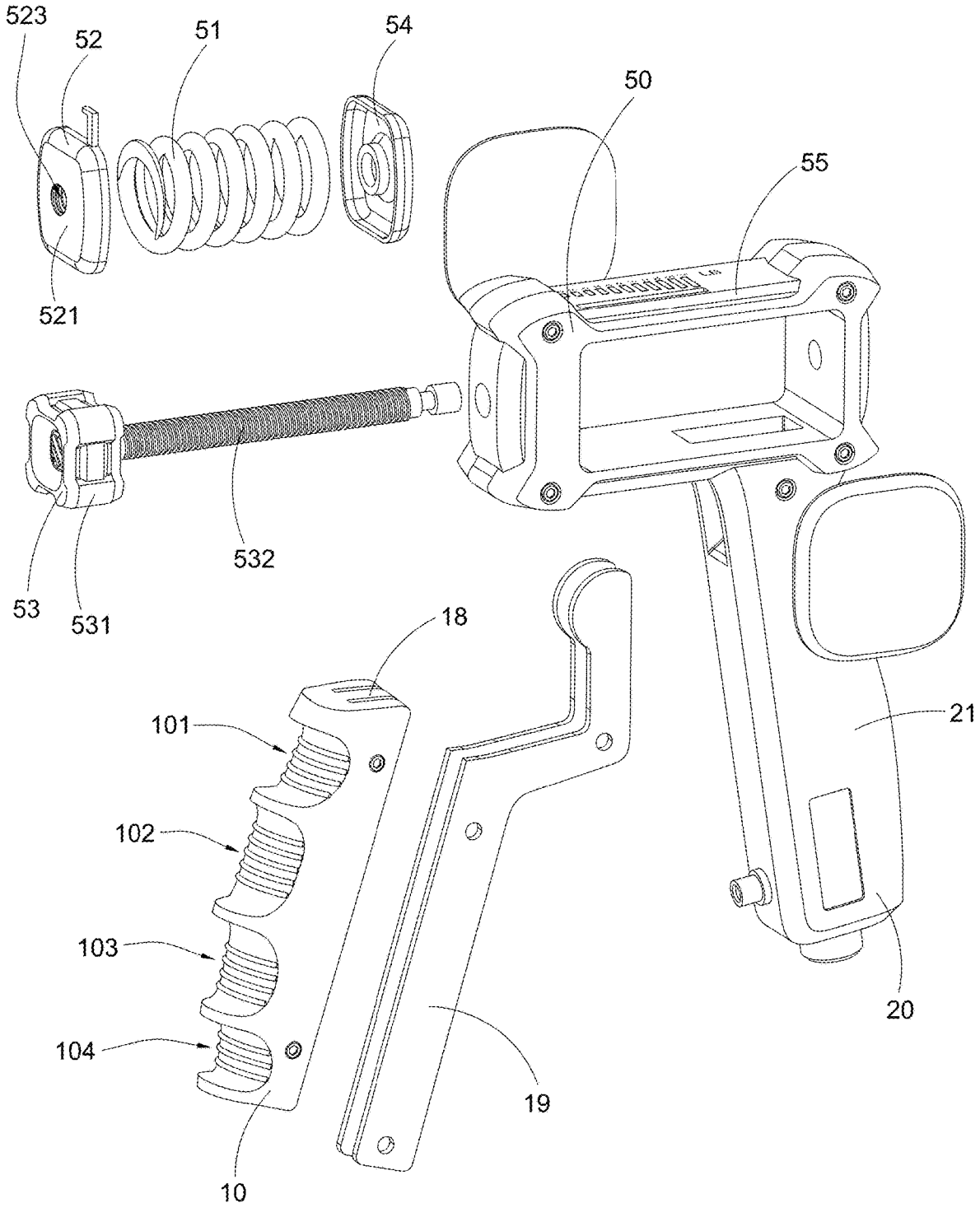
FIG. 18 is an exploded view of the ergonomic hand grip strengthener according to the above third preferred embodiment of the present invention.

Referring to FIGS. 17 and 18 of the drawings, an ergonomic hand grip strengthener according to a third preferred embodiment of the present invention is illustrated, wherein the ergonomic hand grip strengthener comprises a front operation handle 10, a rear operation handle 20, a strength adjustment assembly 50 for being operated for adjusting the resistance.

According to this embodiment, the strength adjustment assembly 50 comprises a spring element 51, a spring driving element 52, an adjustment control element 53, a spring mounting piece 54 and a base arm 55. The spring element 51 is arranged to generate a resistance force to the relative movement between the front operation handle 10 and the rear operation handle 20, the adjustment control element 53 can be operated by the user, so as to drive the spring driving element 52 to move, and thus the spring element 51 is driven to move and deform, so as to adjust the elastic resistance force.

The spring mounting piece 54 is disposed in the base arm 55. The spring element 51 comprises a moving end portion, a fixing end portion, and a spring body extended between the moving end portion and the fixing end portion. The fixing end portion is an end portion that is opposite to the moving end portion and is fixed to the spring mounting piece 54.

As shown in FIG. 20 of the drawings, the spring mounting piece 54 comprises a biasing part for engaging with the front operation handle 10, and a central connecting part for mounting with the fixing end portion of the spring element 51.

The adjustment control element 53 comprises an adjusting knob 531 and a driving shaft 532 connected to the adjusting knob 531, the spring driving element 52 is movably coupled on the driving shaft 532 in a manner that when the adjusting knob 531 is rotated, the spring driving element 52 will be driven to move by the driving shaft 532, so as to further drive the moving end portion of the spring element 51 to move, so that the spring body is deformed into different tension states to generate different resistances to the relative movement between the front operation handle 10 and the rear operation handle 20.

The driving shaft 532 comprises outer threads on an outer surface thereof, the spring driving element 52 comprises a moving member 521 wound around the driving shaft 532. The moving member 521 is a plate having a central hole 523 and comprises inner threads for engaging with the outer threads of the driving shaft 532, so that the moving member 521 is screwed on the driving shaft 532. Therefore, when the adjusting knob 51 is rotated, the driving shaft 532 will be rotating, and the moving member 521 will be driven to move along the driving shaft 532 because of the screwing connection between the driving shaft 532 and the moving member 521, and thus the moving end portion of the spring element 51 connected to the moving member 521 will be driven to move to adjust its position to result in the deformation of the spring body, so that the compression state of the spring body is adjusted, and thus the adjustable resistance of the ergonomic hand grip strengthener can be provided.

In this embodiment, the spring element 51 also can be a compression spring, the movement of the moving end portion of the spring element 31 will result in different compression states of the compression spring, so as to adjust the resistance of the spring element 51 applied to the relative movement between the front operation handle 10 and the rear operation handle 20.

According to this embodiment, the front operation handle 10 is operatively coupled to the spring element 51, the rear operation handle 20 is connected to the base arm 55, so as to allow the front operation handle 10 and the rear operation handle 20 to be moved close to each other or to be moved away from each other for hand strength exercising. The front operation handle 10 comprises a mounting part 19 which is pivotally coupled to the spring element 51 of the strength adjustment assembly 50 and a finger abutting part 18 mounted to the mounting part 19.

Similar to the above first preferred embodiment, the finger abutting part 18 of the the front operation handle 10 has a first holding groove 101, a second holding groove 102, a third holding groove 103 and a fourth holding groove 104 which are respectively define by a first groove profile surface 11, a second groove profile surface 12, a third groove profile surface 13 and a fourth groove profile surface 14, and the configuration of the four holding grooves 101, 102, 103 and 104 allow the stretching distances of the short index finger 42 and the pinky finger 45 to be reduced. A rear extension surface 109 of the front operation handle 10 can be an inclined surface.

In this embodiment, the rear operation handle 20 has a concave groove 201 and comprises a rear abutting surface 202 under the connecting arm 22 for abutting the holding hand 40 of the user. The rear abutting surface 202 comprises a top abutting surface section 2021 for abutting against the back of the thumb 41 and the upper edge portion 461 of the palm 46, a thumb abutting surface section 2022 for abutting an inner surfaces of the thumb 41 and the upper edge portion 461 of the palm 46, a palm abutting surface section 2023 for abutting against the palm 46 of the holding hand 40.

One skilled in the art will understand that the embodiment of the present invention as shown in the drawings and described above is exemplary only and not intended to be limiting.

It will thus be seen that the objects of the present invention have been fully and effectively accomplished. The embodiments have been shown and described for the purposes of illustrating the functional and structural principles of the present invention and are subject to change without departure from such principles. Therefore, this invention includes all modifications encompassed within the spirit and scope of the following claims.

What is claimed is:

1. An ergonomic hand grip strengthener for being gripped by a holding hand of a user, comprising:

a front operation handle for placement of an index finger, a middle finger, a ring finger and a pinky finger of the holding hand of the user;

a rear operation handle for abutting against a thumb and a palm of the holding hand of the user, wherein said rear operation handle comprises an arm body having a rear abutment surface and a protrusion part extended from said arm body at a side of said rear abutment surface for conforming to a groove of the palm of the holding hand of the user; and a strength adjustment assembly for adjusting a resistance applied to approaching movement between said front operation handle and said rear operation handle;

wherein said rear operation handle has a concave groove for placement of the thumb, wherein said concave groove is positioned circumferentially around said rear operation handle and occupying a quarter to three quarters of a circumference of said rear operation handle;

wherein said rear operation handle further has a front surface which is a straight flat surface extended along a vertical direction.

2. An ergonomic hand grip strengthener for being gripped by a holding hand of a user, comprising:

a front operation handle for placement of an index finger, a middle finger, a ring finger and a pinky finger of the holding hand of the user, wherein said front operation handle is configured to allow the pinky finger to be positioned further back than the ring finger, wherein said front operation handle has a first holding groove, a second holding groove, a third holding groove, and a fourth holding groove that each of which is a concave holding groove positioned circumferentially around said front operation handle, wherein said front operation handle further has a middle line that said first holding groove, said second holding groove, and said third holding groove are formed along said middle line while said fourth holding groove is offset along said middle line, such that said fourth holding groove is positioned further back with respect to said third holding groove;

a rear operation handle for abutting against a thumb and a palm of the holding hand of the user; and a strength adjustment assembly for adjusting a resistance applied to approaching movement between said front operation handle and said rear operation handle.

3. The ergonomic hand grip strengthener according to claim 2, wherein said front operation handle is configured to allow the index finger to be positioned further back than the middle finger, wherein said front operation handle comprises a first groove profile surface defining said first holding groove for holding the index finger, a second groove profile surface defining said second holding groove for holding the middle finger, a third groove profile surface defining said third holding groove for holding the ringer finger, and a fourth groove profile surface defining said fourth holding groove for holding the pinky finger, wherein said first through fourth groove profile surfaces are straight and flat surfaces.

4. The ergonomic hand grip strengthener according to claim 2, wherein said front operation handle comprises a front abutting surface which is configured to allow the pinky finger to be positioned further back than the ring finger and allow the index finger to be positioned further back than the middle finger, wherein said front abutting surface of said front operation handle comprises an upper surface section and a lower surface section which is integrally extended from said upper surface section, wherein along a direction from top to bottom, said upper surface section is gradually protruding frontward while said lower surface section is gradually receding backward.

5. The ergonomic hand grip strengthener according to claim 2, wherein said front operation handle has a rear extension surface which is a straight and flat surface.

6. The ergonomic hand grip strengthener according to claim 2, wherein said rear operation handle comprises a rear abutment surface which has a substantial S-shape, wherein at least one of said front operation handle and said rear operation handle is provided with a plurality of resilient protrusions at each of said first though fourth holding groove and a rear surface of said rear operation handle.

* * * * *